US006781111B2

(12) United States Patent
Mukai

(10) Patent No.: US 6,781,111 B2
(45) Date of Patent: Aug. 24, 2004

(54) PAPER PROCESSING APPARATUS

(75) Inventor: Masanori Mukai, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 272 days.

(21) Appl. No.: 10/097,933

(22) Filed: Mar. 15, 2002

(65) Prior Publication Data

US 2002/0096299 A1 Jul. 25, 2002

Related U.S. Application Data

(63) Continuation of application No. PCT/JP99/06565, filed on Nov. 25, 1999.

(51) Int. Cl.[7] ..... B65H 7/02

(52) U.S. Cl. ..... 250/223 R; 250/559.27; 271/261; 271/265.01

(58) Field of Search ..... 250/559.11, 559.2, 250/559.27, 559.3, 559.36, 559.39, 223 R, 221; 271/227, 261, 263, 265.01–265.04; 235/379

(56) References Cited

U.S. PATENT DOCUMENTS 5,174,562 A * 12/1992 Mizunaga et al. ..... 271/261

6,672,587 B1 * 1/2004 Mohringer et al. ..... 271/259

FOREIGN PATENT DOCUMENTS

| | | |
|---|---|---|
| JP | 5-46842 | 3/1993 |
| JP | 7-119600 | 12/1995 |
| JP | 8-175700 | 7/1996 |
| JP | 8-249524 | 9/1996 |
| JP | 9-293162 | 11/1997 |
| JP | 10-194526 | 7/1998 |
| JP | 10-269399 | 10/1998 |
| JP | 10-291691 | 11/1998 |
| JP | 11-120414 | 4/1999 |

* cited by examiner

*Primary Examiner*—Kevin Pyo
(74) *Attorney, Agent, or Firm*—Armstrong, Kratz, Quintos, Hanson & Brooks, LLP

(57) ABSTRACT

Includes a sensor section (240) which irradiates light onto paper that is being conveyed and which detects a quantity of light transmitted through the paper, and a type-of-money judging section (290) and a number-of-sheet-of-paper collating section (320) which correct a light transmission quantity when the external shape of paper obtained from the light transmission quantity coincides with a prescribed shape and also when the light transmission quantity is lower than a pre-set threshold value, and judge types of money and a number of sheets of paper based on a result of this correction.

3 Claims, 15 Drawing Sheets

PAPER PROCESSING APPARATUS

This application is a continuation of international application PCT/JP99/06565 filed on Nov. 25, 1999.

TECHNICAL FIELD

The present invention relates to a paper processing apparatus which judges types of money and the original or an imitation of money while conveying sheets of paper like bank notes. Particularly, the invention relates to a paper processing apparatus which is built into an automatic teller machine (hereinafter to be referred to as an ATM) that executes an automatic transaction of a reception and a payment of bank notes.

BACKGROUND ART

Recently, automation has been progressed in various fields, and types of paper, such as bank notes and admission tickets, have also been judged automatically with a paper processing apparatus. This paper processing apparatus is built into an ATM, for example. Further, unattended operation of the ATM has also been progressed as a recent trend. However, as the span for an operator to maintain and inspect the ATM becomes long, there have been many problems in the unattended operation.

A conventional paper processing apparatus is built into the ATM. This paper processing apparatus is mainly constructed of: an optical sensor which detects a design of front and back sides of each sheet of paper sequentially conveyed at high speed, and a light quantity corresponding to a shading of the paper; an amplifier which amplifies an output of the optical sensor at a desired amplification factor; an A/D converter which A/D (Analog/Digital) converts the output of the amplifier; and a judging section which judges a type of paper like types of money and distinguishes between the original and an imitation of the money, by comparing the output of the A/D converter with dictionary data prepared in advance to make judgement.

According to the conventional paper processing apparatus, it is not possible to judge types of money when two or more sheets of paper are conveyed in a superimposed status (double fed) or when sheets of paper are conveyed with excessively small distance between the sheets of paper. Therefore, in this case, the sheets of paper for which it has not been possible to judge types of money are handled as indefinite types of money, and these sheets of paper are accommodated in a reject box or are returned to a customer who entered these sheets of paper.

When a conventional paper processing apparatus is applied to an ATM which has a function that could easily generate an abnormal status in the conveyance of paper, like double feeding, a rejection rate (the number of sheets of paper that have been handled as indefinite types of money/the number of sheets of paper that have been conveyed) naturally becomes high. Consequently, the entered paper is frequently returned to customers. Therefore, the conventional paper processing apparatus has had a problem that it is very inconvenient for the customers to handle this paper processing apparatus.

Further, while the unattended operation of the ATM has been progressed recently, there is a tendency that the span for an operator to recover sheets of paper from the rejection box becomes long, because of the nature of the operation mode of the unattended ATM. Therefore, this operation mode has had a drawback in that when a rejection rate is high, the rejection box becomes full before the operator recovers sheets of paper, and this causes problems in the operation.

Further, according to the ATM of the unattended operation mode, a monitoring sensor remote monitors a total amount of bank notes held in the apparatus. A number of sheets of bank notes and types of money to be filled/recovered are determined based on a result of this remote monitoring. However, in the ATM, as the types of money and the number of sheets of bank notes accommodated in the rejection box are indefinite, it is not possible to accurately understand the total amount of bank notes at the monitoring sensor side. Therefore, this has had a problem in the operation.

Therefore, it is an object of the present invention to provide a paper processing apparatus which is capable of improving the precision in deciding types of bank notes and deciding a number of sheets of money, and is capable of carrying out a smooth operation.

DISCLOSURE OF THE INVENTION

According to the present invention, there is provided a paper processing apparatus comprising: a conveying unit (corresponding to a conveying motor 112, a conveying belt 113, and a central processing unit 210 in one embodiment to be described later) which conveys sheets of paper after taking them out; a light irradiating unit (corresponding to an optical sensor 241 in one embodiment to be described later) which irradiates light onto the sheets of paper that are being conveyed; a light transmission quantity detecting unit (corresponding to the optical sensor 241 in one embodiment to be described later) which detects a quantity of light transmitted through the paper; an external shape judging unit (corresponding to a type-of-money judging section 290 in one embodiment to be described later) which judges whether an external shape of the paper obtained from the light transmission quantity coincides with a prescribed shape or not; a correcting unit (corresponding to the type-of-money judging section 290 in one embodiment to be described later) which corrects the light transmission quantity, when a result of the judgement of the external shape judging unit shows that the external shape of the paper coincides with the prescribed shape and also when the light transmission quantity is lower than a light transmission quantity threshold value that has been set in advance; and a distinguishing unit (corresponding to the type-of-money judging section 290 in one embodiment to be described later) which distinguishes types of money and a number of sheets of paper, based on a light transmission quantity that has been corrected by the correcting unit.

According to this invention, when a plurality of sheets of paper have been conveyed in a status that they are completely superimposed with each other at the time of taking out these sheets of paper, the light transmission quantity of the sheets of paper becomes smaller than the light transmission quantity threshold value. Therefore, it is not possible to distinguish types of money and a number of sheets of paper, based on the light transmission quantity. Further, as the plurality of sheets of paper are completely superimposed with each other, the external shape judging unit judges that the external shape of these sheets of paper coincides with the prescribed shape. Therefore, in this case, the correcting unit corrects the light transmission quantity of the sheets of paper, and the distinguishing unit distinguishes the types and the number of sheets of paper, based on the corrected light transmission quantity.

As explained above, according to the present invention, when the light transmission quantity of the sheets of paper to be distinguished is lower than the light transmission quantity threshold value, the light transmission quantity is corrected. Therefore, even when the plurality of sheets of paper are completely in a superimposed status, it is possible to improve the precision in judging the types and the number of sheets of paper, and it is possible to carry out a smooth operation.

Further, according to the present invention, there is provided a paper processing apparatus comprising: a conveying unit (corresponding to a conveying motor 112, a conveying belt 113, and a central processing unit 210 in one embodiment to be described later) which conveys sheets of paper after taking them out; a light irradiating unit (corresponding to an optical sensor 241 in one embodiment to be described later) which irradiates light onto the sheets of paper that are being conveyed; a light transmission quantity detecting unit (corresponding to the optical sensor 241 in one embodiment to be described later) which detects a quantity of light transmitted through the paper; a light reflection quantity detecting unit (corresponding to the optical sensor 241 in one embodiment to be described later) which detects a light reflection quantity on the front and back surfaces of the sheets of paper; an external shape judging unit (corresponding to a type-of-money judging section 290 in one embodiment to be described later) which judges whether an external shape of the paper obtained from the light transmission quantity coincides with a prescribed shape or not; and a distinguishing unit (corresponding to the type-of-money judging section 290 in one embodiment to be described later) which distinguishes types of money and a number of sheets of paper, based on the light reflection quantity, when a result of the judgement of the external shape judging unit shows that the external shape of the paper does not coincide with the prescribed shape.

According to this invention, when two sheets of paper have been conveyed in a status that a part of a sheet of paper is superimposed with the other sheet, for example, the external shape judging unit judges that the external shape of these sheets of paper does not coincide with the prescribed shape. Therefore, in this case, the distinguishing unit distinguishes the type and the number of sheet of paper, for one of the sheets of paper, based on the light reflection quantity on the front surface of the paper. At the same time, the distinguishing unit distinguishes the type and the number of sheet of paper, for the other sheet of the paper, based on the light reflection quantity on the back surface of the paper.

As explained above, according to the present invention, when the external shape of the sheets of paper to be distinguished does not coincide with the prescribed shape, the types of money and the number of sheets of paper are distinguished based on the light reflection quantity on the front and back surfaces of the sheets of paper. Therefore, even when two sheets of paper have been conveyed in a status that a part of a sheet of paper is superimposed with the other sheet, it is possible to distinguish in high precision.

Further, the present invention, in the paper processing apparatus, comprises: a memory unit (corresponding to a memory section 350 in one embodiment to be described later) which stores data of types of money and a total number of sheets of paper held in the apparatus; and a data updating unit (corresponding to the central processing unit 210, and a correcting section 340 in one embodiment to be described later) which updates the data stored in the memory unit, based on the types of money and the number of sheets of paper distinguished by the distinguishing unit.

According to this invention, the data updating unit updates data stored in the memory unit, based on the types and the number of sheets of paper conveyed in a superimposed status. Therefore, it is always possible to accurately understand the types and the number of sheets of paper stored in the apparatus.

Further, the present invention, in the paper processing apparatus, comprises: a number-of-sheets-of-paper collating unit (corresponding to the central processing unit 210, and a number-of-sheet-of-paper collating section 320 in one embodiment to be described later) which collates the number of sheets of paper taken out by the conveying unit with the number of sheets of paper distinguished by the distinguishing unit, wherein the data updating unit updates the data based on a result of the collation by the number-of-sheets-of-paper collating unit.

According to this invention, the number-of-sheets-of-paper collating unit updates the data, based on a result of the collation between the number of sheets of paper actually taken out by the conveying unit and the number of sheets of paper distinguished by the distinguishing unit. Therefore, it is possible to improve the reliability of the data.

Further, according to the present invention, there is provided a paper processing apparatus comprising: a conveying unit (corresponding to a conveying motor 112, a conveying belt 113, and a central processing unit 210 in one embodiment to be described later) which conveys sheets of paper after taking them out; a light irradiating unit (corresponding to an optical sensor 241 in one embodiment to be described later) which irradiates light onto the sheets of paper that are being conveyed; a light transmission quantity detecting unit (corresponding to a sensor section 240 in one embodiment to be described later) which detects a quantity of light transmitted through the paper; a distinguishing unit (corresponding to a type-of-money judging section 290 in one embodiment to be described later) which distinguishes types of money and a number of sheets of paper, at least based on the light transmission quantity: an external shape judging unit (corresponding to the type-of-money judging section 290 in one embodiment to be described later) which judges whether an external shape of the paper obtained from the light transmission quantity coincides with a prescribed shape or not; a superimposed-conveyance judging unit (corresponding to the central processing unit 210 in one embodiment to be described later) which judges whether a plurality of sheets of paper are being conveyed in a superimposed status or not, based on a result of a decision made by the external shape judging unit or based on the light transmission quantity; and a saving unit (corresponding to the central processing unit 210 in one embodiment to be described later) which temporarily saves the sheets of paper at a predetermined position, when the superimposed-conveyance judging unit has judged that a plurality of sheets of paper are being conveyed in a superimposed status, wherein the conveying unit takes out the temporarily-saved sheets of paper, and re-conveys these sheets of paper, and the distinguishing unit re-distinguishes the types of money and the number of sheets of paper that have been re-conveyed.

According to this invention, when a plurality of sheets of paper have been conveyed in a superimposed status at the time of taking out these sheets of paper, the saving unit temporarily saves these sheets of paper at a predetermined position. Then, the conveying unit takes out the temporarily-saved sheets of paper, and re-conveys them. At the time of taking out the sheets of paper, there is a high probability that the plurality of sheets of paper are sequentially taken out one by one. In other words, the sheets of paper are conveyed one by one at the re-conveyance time. Therefore, at the time of the re-distinction by the distinguishing unit, it is possible to accurately distinguish the types and the number of sheets of paper.

As explained above, according to the present invention, the sheets of paper that have been conveyed in a superimposed status are temporarily saved, and they are conveyed again and distinguished again. Therefore, it is possible to increase the probability that the sheets of paper are sequentially taken out one by one from the superimposed status. As a result, it is possible to improve the precision in judging the types of money and judging the number of sheets of paper.

Further, according to the present invention, there is provided a paper processing apparatus comprising: a conveying unit (corresponding to a conveying motor 112, a conveying belt 113, and a central processing unit 210 in one embodiment to be described later) which conveys sheets of paper after taking them out; a light irradiating unit (corresponding to an optical sensor 241 in one embodiment to be described later) which irradiates light onto the sheets of paper that are being conveyed; a light transmission quantity detecting unit (corresponding to the optical sensor 241 in one embodiment to be described later) which detects a quantity of light transmitted through the paper; a light reflection quantity detecting unit (corresponding to the optical sensor 241 in one embodiment to be described later) which detects a light reflection quantity on the front and back surfaces of the sheets of paper; a thickness detecting unit (corresponding to a thickness sensor 242 in one embodiment to be described later) which mechanically detects the thickness of the paper; an external shape judging unit (corresponding to a type-of-money judging section 290 in one embodiment to be described later) which judges whether an external shape of the paper obtained from the light transmission quantity coincides with a prescribed shape or not; and a distinguishing unit (corresponding to the type-of-money judging section 290 in one embodiment to be described later) which distinguishes types of money and a number of sheets of paper, based on the light reflection quantity, the light transmission quantity, and a result of the detection by the thickness detecting unit, when a result of the judgement of the external shape judging unit shows that the external shape of the paper does not coincide with the prescribed shape.

According to this invention, when two sheets of paper have been conveyed in a status that a part of a sheet of paper is superimposed with the other sheet, or when sheets of paper have been conveyed in a status that a foreign material has been adhered to the paper, for example, the external shape judging unit judges that the external shape of these sheets of paper does not coincide with the prescribed shape. Further, the thickness detecting unit detects the thickness of the paper. The distinguishing unit distinguishes the types of money and the number of sheets of paper, based on the three elements, including the light reflection quantity on both the front and back surfaces of the paper, the light transmission quantity, and the result of the detection by the thickness detecting unit.

As explained above, according to the present invention, the distinction is carried out based on the three elements, including the light reflection quantity, the light transmission quantity, and the result of the detection by the thickness detecting unit. Therefore, when it is not possible to carry out the distinction based on only one element, it becomes possible to achieve the distinction based on other elements. As a result, it is possible to distinguish the types and the number of sheets of paper in high precision.

BEST MODE FOR CARRYING OUT THE INVENTION

The present invention will be explained in detail below with reference to the attached drawings.

Figure 1:
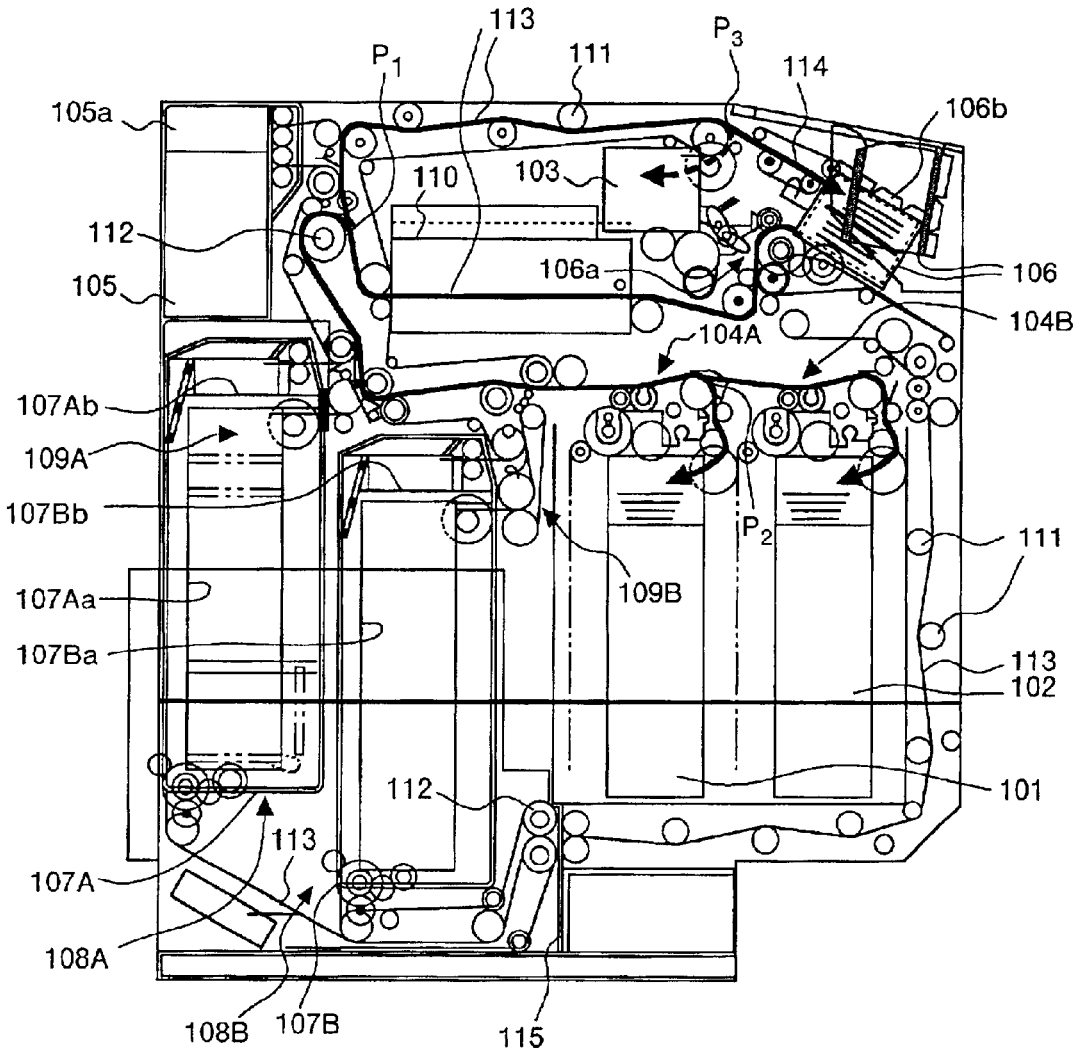
FIG. 1 is side cross-sectional diagram showing a structure of an ATM to which one embodiment relating to the present invention is applied.

FIG. 1 is side cross-sectional diagram showing a structure of an ATM to which one embodiment relating to the present invention is applied. The ATM shown in FIG. 1 is an apparatus which automatically carries out a transaction of a reception of bank notes and a payment of bank notes from/to customers. The drawing does not show a coin handling section which handles coins, a bank book reading section which optically reads bankbooks, a card reader which magnetically or electrically reads cash cards, a display section which displays information necessary for the transaction, and an input section which is used to input numbers.

In the following explanation, the right-hand side of the drawing will be called a "front surface side", and the left-hand side of the drawing will be called a "back surface side". The ATM shown in the drawing has a thousand-yen note stacker 101, a ten-thousand-yen note stacker 102, a five-thousand-yen note box 103, a take-out accommodation mechanism 104A, and a take-out accommodation mechanism 104B. The thousand-yen note stacker 101 and the ten-thousand-yen note stacker 102 accommodate thousand-yen notes and ten-thousand-yen notes respectively. The five-thousand-yen note box 103 temporarily accommodates five-thousand-yen notes.

The take-out accommodation mechanism 104A is disposed above the thousand-yen note stacker 101, and has a mechanism that takes out thousand-yen notes from the thousand-yen note stacker 101, and a mechanism that accommodates thousand-yen notes into the thousand-yen note stacker 101. The take-out accommodation mechanism 104B is disposed above the ten-thousand-yen note stacker 102, and has a mechanism that takes out ten-thousand-yen notes from the ten-thousand-yen note stacker 102, and a mechanism that accommodates ten-thousand-yen notes into the ten-thousand-yen note stacker 102.

Thousand-yen notes and ten-thousand-yen notes that are accommodated in the thousand-yen note stacker 101 and the ten-thousand-yen note stacker 102 respectively are utilized to make payment from the ATM to customers. In the mean time, five-thousand-yen notes that are accommodated in the five-thousand-yen note box 103 are recovered without being utilized to make payment.

A rejection box 105 is disposed above the back surface side of the ATM, and this rejection box 105 accommodates sheets of paper of which types of money are indefinite. A five-thousand-yen note chamber 105*a* is provided within this rejection box 105. This five-thousand-yen note chamber 105*a* accommodates five-thousand-yen notes that are transferred from the five-thousand-yen note box 103.

An entering box 106 is disposed above the front surface side of the ATM. This entering box 106 has a role of an entering-opening for customers to enter bank notes from the outside of the ATM, and a role of a take-out opening for customers to take out bank notes from the ATM to the outside. A take-out mechanism 106*a* that takes out bank notes from the entering box 106 is disposed near this entering box 106.

The inside of the entering box 106 is partitioned into two spaces with a partition plate 106*b*. One of the two spaces accommodates bank notes entered by customers. The other space accommodates sheets of paper of which types of money are indefinite and shapes are abnormal, among the sheets of paper that have been once taken into the ATM from the entering box 106.

A cassette 107A is disposed at the back surface side of the ATM, and has a paper chamber 107A*a* and a rejection chamber 107A*b*. A take-out mechanism 108A is disposed at a lower portion of the cassette 107A, and this take-out mechanism 108A is a mechanism that takes out paper from the cassette 107A. An accommodation mechanism 109A is disposed at an upper portion of the cassette 107A, and this accommodation mechanism 109A is a mechanism that accommodates paper in the cassette 107A.

The paper chamber 107A*a* accommodates thousand-yen notes and ten-thousand-yen notes to be recovered by a manager, after these notes have been transferred from the thousand-yen note stacker 101 and the ten-thousand-yen note stacker 102 respectively. The paper chamber 107A*a* also accommodates thousand-yen notes and ten-thousand-yen notes to be replenished (transferred) to the thousand-yen note stacker 101 and the ten-thousand-yen note stacker 102 respectively. The rejection chamber 107A*b* accommodates sheets of paper having abnormal shapes that have been found during a transfer of sheets of bank notes from the paper chamber 107A*a* to the thousand-yen note stacker 101 and the ten-thousand-yen note stacker 102 respectively.

A cassette 107B is disposed near the cassette 107A, and this cassette 107B is used as a preparatory cassette of the cassette 107A. In other words, the cassette 107B is used when the quantity of bank notes accommodated in the thousand-yen note stacker 101 and the ten-thousand-yen note stacker 102 has exceeded the quantity of bank notes that can be accommodated in the cassette 107A. This cassette 107B also has a paper chamber 107B*a* and a rejection chamber 107B*b*, in a similar manner to that of the cassette 107A. A take-out mechanism 108B that takes out bank notes from the cassette 107B is disposed at a lower portion of the cassette 107B. An accommodation mechanism 109B that accommodates bank notes in the cassette 107B is disposed at an upper portion of the cassette 107B.

A distinguishing unit 110 is disposed slightly above the center of the ATM, and this distinguishing unit 110 judges types of money and judges the original or an imitation of bank notes. Inside the ATM, there are disposed conveying rollers 111, 111, . . . , a conveying motor 112, and conveying belts 113, 113, . . . , respectively. The conveying belts 113, 113, . . . are endless belts that are supported by the conveying rollers 111, 111, . . . , and are driven by the conveying motor 112.

The conveying belts 113, 113, . . . convey sheets of paper (not shown) to corresponding portions, and pass the sheets of paper within the distinguishing unit 110. The conveying routes of the sheets of paper are changed according to the operation modes (a note-reception mode, a note-payment mode, a note-replenishment mode, and a note-recovery mode) of the ATM, as shown by thick lines in FIG. 1 to FIG. 4 respectively. The operation modes will be explained in detail later. A gate 114 is disposed at a branch point of the conveying route, and this gate 114 changes the conveying route. A control section 115 controls the driving of each section of the apparatus and controls the distinguishing unit 110. The operation of the control section 115 will be explained in detail later.

Figure 5:
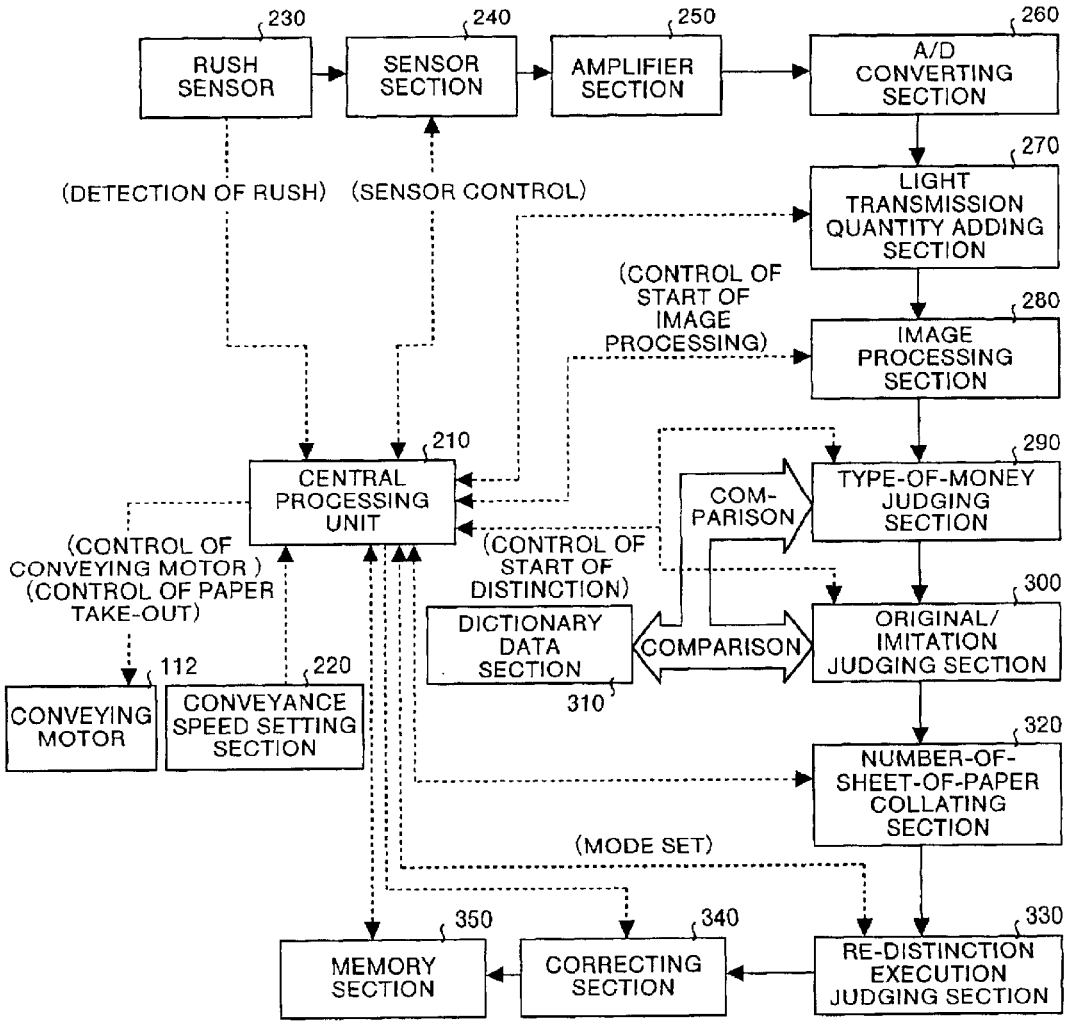
FIG. 5 is a block diagram showing an electric structure of one embodiment relating to the present invention.

FIG. 5 is a block diagram showing an electric structure of one embodiment relating to the present invention. FIG. 5 shows a paper processing apparatus according to one embodiment. This paper processing apparatus is built into the ATM shown in FIG. 1. In FIG. 5, portions corresponding to those in FIG. 1 are attached with like reference numbers.

In this drawing, a central processing unit 210 controls each section, and is accommodated within the control section 115 (refer to FIG. 1). The operation of this central processing unit 210 will be explained in detail later. A conveyance speed setting section 220 sets a speed at which the conveying belt 113 shown in FIG. 1 conveys sheets of paper. In other words, this conveyance speed setting section 220 sets a rotation number of the conveying motor 112.

Figure 6:
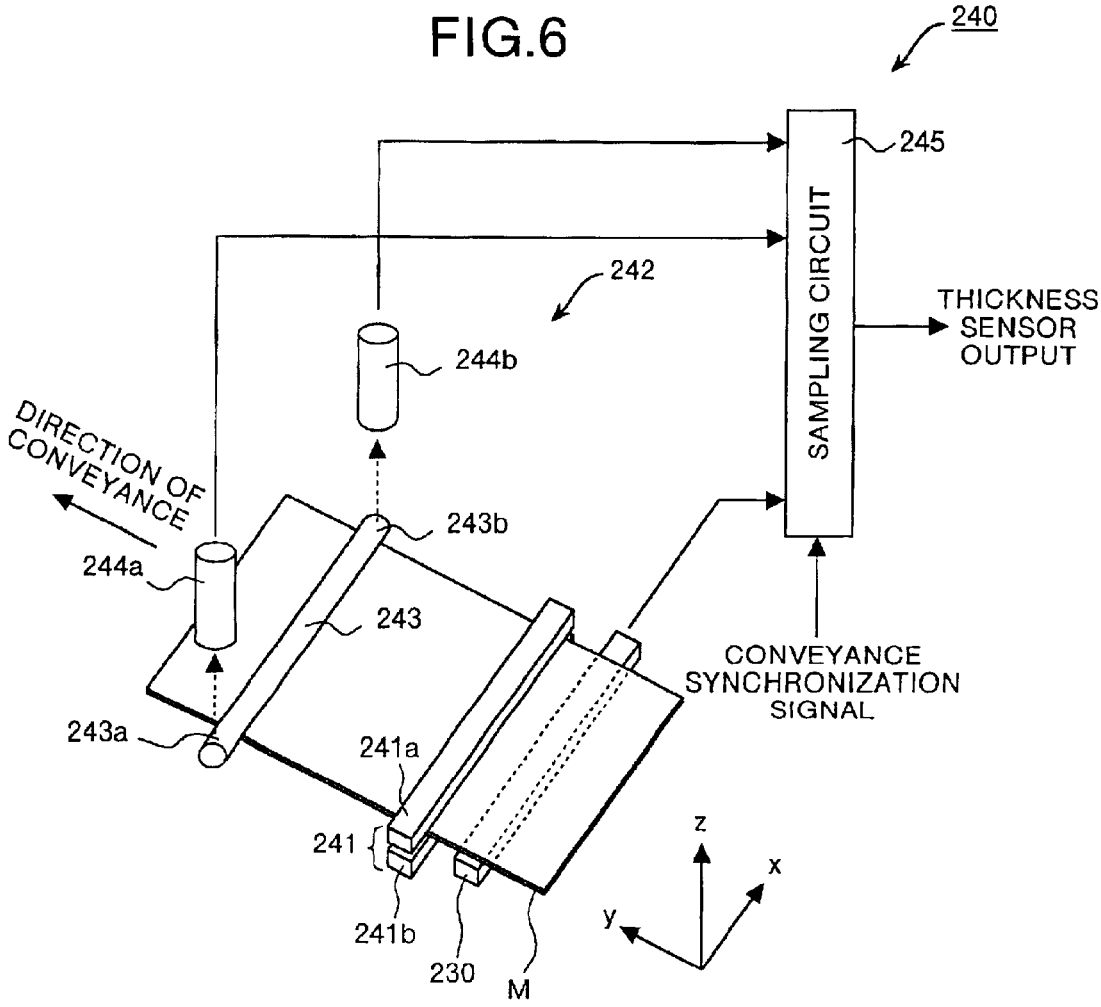
FIG. 6 is a perspective diagram showing a structure of a sensor section 240 shown in FIG. 5.

A rush sensor 230 is provided within the distinguishing unit 110, and this rush sensor 230 is an optical sensor which optically detects a sheet or a plurality of sheets of paper M shown in FIG. 6 that has or have rushed into (entered) the distinguishing unit 110. The rush sensor 210 controls each section, triggered by the detection of a rush by the rush sensor 230. A sensor section 240 is provided within the distinguishing unit 110, and is constructed of an optical sensor 241 and a thickness sensor 242 shown in FIG. 6.

Figure 7:
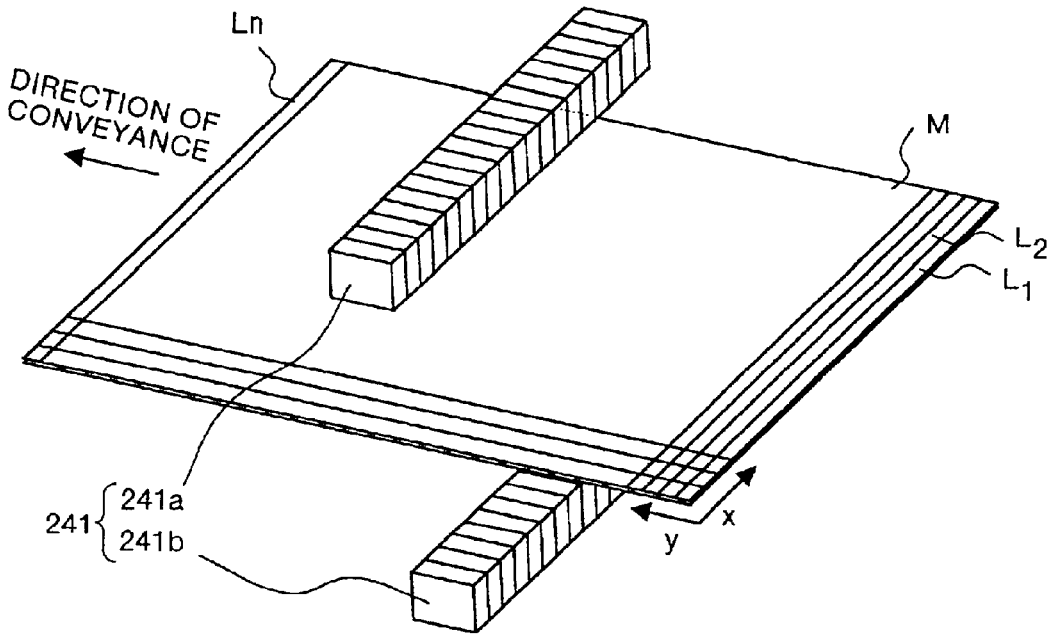
FIG. 7 is a perspective diagram showing a structure of an optical sensor 241 shown in FIG. 6.

The optical sensor 241 is constructed of a first optical sensor 241*a* and a second optical sensor 241*b* that are disposed to sandwich paper M between these sensors, in a direction (a z direction) perpendicular to a direction (a y direction) of conveying the paper M shown in FIG. 7. The first optical sensor 241*a* is constructed of a plurality of light emitters/light receivers disposed in an array shape in an x direction in FIG. 7. Similarly, the second optical sensor 241*b* is constructed of a plurality of light emitters/light receivers disposed in an array shape in the x direction in FIG. 7. The plurality of light emitters/light receivers of the first optical sensor 241*a* and the plurality of light emitters/light receivers of the second optical sensor 241*b* correspond to one pixel of the paper M respectively.

The first optical sensor 241*a* and the second optical sensor 241*b* detect a reflection light and a transmission light from the front surface and the back surface of the paper M in a line unit from a line $L_1$ to a line $L_n$, respectively. More specifically, the central processing unit 210 controls the light-emission timings of the light emitters of the first optical sensor 241*a* and the second optical sensor 241*b* respectively such that their light-emission timings are different. As a result, while the light emitters of the first optical sensor 241*a* are emitting lights, the light receivers of the first optical sensor 241*a* detect lights that are reflected from the front surface of the paper M. At the same time, the light receivers of the second optical sensor 241*b* detect lights that are transmitted through the paper M.

Similarly, while the light emitters of the second optical sensor 241*b* are emitting lights, the light receivers of the second optical sensor 241*b* detect lights that are reflected from the back surface of the paper M. At the same time, the light receivers of the first optical sensor 241*a* detect lights that are transmitted through the paper M. In other words, the optical sensor 241 detects four kinds of lights as images that include the lights reflected from the front surface of the paper M, the lights reflected from the back surface of the paper M, the lights transmitted from the front surface to the back surface the paper M, and the lights transmitted from the back surface to the front surface the paper M.

The thickness sensor 242 shown in FIG. 6 is a sensor that mechanically detects a thickness of the paper M. This thickness sensor 242 has a displacement roller 243, a thickness detecting section 244*a*, a thickness detecting section 244*b*, and a sampling circuit 245. The displacement roller 243 is in contact with the front surface of the paper M that is being conveyed, and is disposed in flexible displacement in a direction (a z direction) perpendicular to a conveying direction (a y direction). This displacement roller 243 is displaced in the z direction depending on the thickness of the paper M.

The thickness detecting section 244*a* is a sensor which detects displacement of one end portion 243*a* of the displacement roller 243 in the z direction, and outputs a result of detecting the displacement to the sampling circuit 245. Similarly, the thickness detecting section 244*b* is a sensor which detects displacement of the other end portion 243*b* of the displacement roller 243 in the z direction, and outputs a result of detecting the displacement to the sampling circuit 245.

The sampling circuit 245 samples the results of detecting the displacement that are input from the thickness detecting section 244*a* and the thickness detecting section 244*b* respectively, in synchronism with a conveyance synchronization signal, triggered by a rush detection signal from the rush sensor 230. This conveyance synchronization signal is supplied from the central processing unit 210. The sampling circuit 245 outputs a thickness sensor output value data corresponding to the thickness of the paper M to the central processing unit 210.

Referring back to FIG. 5, an amplifier section 250 amplifies an output signal (for example, a signal corresponding to a light transmission quantity) from the optical sensor 241 (the first optical sensor 241*a* and the second optical sensor 241*b*) at a predetermined amplification factor. An A/D converting section 260 digitizes output signals of the amplifier section 250, and outputs the digital output signals as image data. A light transmission quantity adding section 270 adds light transmission quantities in one pixel unit corresponding to the image data from the A/D converting section 260 for the whole pixels.

An image processing section 280 carries out image processing like an inclination correction (a coordinate conversion) processing and a normalization processing of the image data from the light transmission quantity adding section 270. A type-of-money judging section 290 judges types of money of bank notes, based on dictionary data that is stored in a dictionary data section 310 and image data from the image processing section 280. The dictionary data is image data based on reflection lights and transmission light for each of the whole kinds of bank notes that becomes a standard which judges types of money of bank notes. The dictionary data includes a table (refer to FIG. 8) corresponding to a thickness distribution of bank notes.

An original/imitation judging section 300 judges the original or an imitation of a bank note based on the dictionary data. A number-of-sheet-of-paper collating section 320 collates a taken-out number of sheets of paper with a number of sheets based on results of judgement by the type-of-money judging section 290 and the original/imitation judging section 300, and passes a result of the collation to the central processing unit 210. A re-distinction execution judging section 330 judges presence or absence of the implementation of re-distinction of the sheets of paper, based on a mode (a rejection mode or a re-distinction mode) that is set by the central processing unit 210. The rejection mode is a mode in which a sheet of paper is stored in the rejection box 105 (refer to FIG. 1) when the type-of-money judging section 290 has not been able to judge a type of money of this sheet of paper. On the other hand, the re-distinction mode is a mode in which a sheet of paper is re-distinguished when it has not bee possible to judge a type of money of this sheet of paper.

The correcting section 340 corrects the light transmission quantity when the sensor section 240 has detected a plurality of sheets of paper that have been completely superimposed with each other. A plurality of sheets of paper are completely superimposed with each other in the case of new bank notes having continuous serial numbers that are called completely blocked notes. The completely blocked notes are superimposed in a status that directions and patterns of these notes match completely respectively due to static electricity. The memory section 350 stores data relating to types of money and a number of sheets of paper within the ATM.

The note-reception mode, the note-payment mode, the note-replenishment mode, and the note-recovery mode that are the basic operation modes of the ATM will be explained next. The operation of the ATM in the note-reception mode will be explained first with reference to FIG. 1 and FIG. 5 to FIG. 13. Referring to FIG. 1, when a customer has entered bank notes into the entering box 106, the entering box 106 is moved downwards. The entered bank notes are mounted on the lower side of the partition plate 106*b*.

The take-out mechanism 106*a* takes out the sheets of bank notes one by one. Then, the conveying belt 113 that is driven by the conveying motor 112 conveys each sheet of bank notes toward the distinguishing unit 110 that is positioned at the left side of the drawing. When the rush sensor 230 has detected the paper M as shown in FIG. 6, the central processing unit 210 shown in FIG. 5 controls each section of the sensor section 240 to detect the transmission light, the reflection light, and the thickness of the paper M respectively.

The optical sensor 241 detects in one line unit the transmission light and the reflection light of the paper M that is being conveyed. The optical sensor 241 outputs a result of the detection to the amplifier section 250 and the central processing unit 210. When the paper M has been conveyed to a lower position of the displacement roller 243, the displacement roller 243 is displaced to the z direction according to the thickness of the paper M. The thickness detecting section 244*a* and the thickness detecting section 244*b* detect this displacement. Results of the detection by the thickness detecting section 244*a* and the thickness detecting section 244*b* are input to the sampling circuit 245 respectively. The sampling circuit 245 outputs the thickness sensor output values corresponding to the thickness of the paper M to the central processing unit 210.

The amplifier section 250 amplifies the output signals from the first optical sensor 241*a* and the second optical sensor 241*b* respectively, and the A/D converting section 260 converts these output signals into digital data. The light transmission quantity adding section 270 adds light transmission quantities in one pixel unit corresponding to the image data from the A/D converting section 260 for the whole pixels. Next, the image processing section 280 carries out image processing like an inclination correction (a coordinate conversion) processing and a normalization processing of the image data from the light transmission quantity adding section 270.

Next, the type-of-money judging section 290 judges a type of money of the paper M, by checking whether the pattern of the dictionary data that is stored in the dictionary data section 310 matches the pattern of the image data from the image processing section 280. The type-of-money judging section 290 outputs a result of judging the type of money to the central processing unit 210. The central processing unit 210 proceeds to step SA1 shown in FIG. 10, and judges whether the type-of-money judging section 290 has been able to judge the type of money or not.

In this case, when the type-of-money judging section 290 has been able to judge the type of money, the central processing unit 210 proceeds to step SA6, and executes the normal processing. In other words, the central processing unit 210 instructs the original/imitation judging section 300 to start distinguishing the paper. Based on this, the original/imitation judging section 300 judges the original or an imitation of the paper M based on the dictionary data and the image data from the image processing section 280. When the paper M is the original note as a result of the original/imitation judgement, the number-of-sheet-of-paper collating section 320 collates the number of sheets of the paper M that have been taken out from the entering box 106, with the number of sheets based on the results of judgement by the type-of-money judging section 290 and the original/imitation judging section 300, and the number of sheets of paper that have been taken out from the entering box 106. The number-of-sheet-of-paper collating section 320 passes a result of the collation to the central processing unit 210. When the numbers of sheets of paper coincide with each other as a result of the collation, the central processing unit 210 updates the data relating to the type of money and the number of sheets of paper in the memory section 350, and finishes a series of judgement.

When sheets of paper have been distinguished as the original thousand-yen notes by the distinguishing unit 110 shown in FIG. 1, these original bank notes are conveyed to the branch point $P_1$ by the conveying belt 113. When sheets of paper are the original thousand-yen notes, a gate (not shown) disposed at the branch point $P_1$ selects a conveying route that directs downwards from this branch point $P_1$. Therefore, in this case, these bank notes are passed through this conveying route, and are conveyed to the thousand-yen note stacker 101 side by a branch point $P_2$. Then these bank notes are accommodated in the thousand-yen note stacker 101.

When sheets of paper have been distinguished as the original ten-thousand-yen notes by the distinguishing unit 110 shown in FIG. 1, these original bank notes are passed through the conveying route toward the downstream of the branch point $P_1$ by the conveying belt 113. Then these bank notes are accommodated in the ten-thousand-yen note stacker 102. When sheets of paper have been distinguished as the original five-thousand-yen notes by the distinguishing unit 110, these original bank notes are accommodated in the five-thousand-yen note box 103 positioned at a left lower side of a branch point $P_3$, via the conveying route above the branch point $P_1$.

Figure 10:
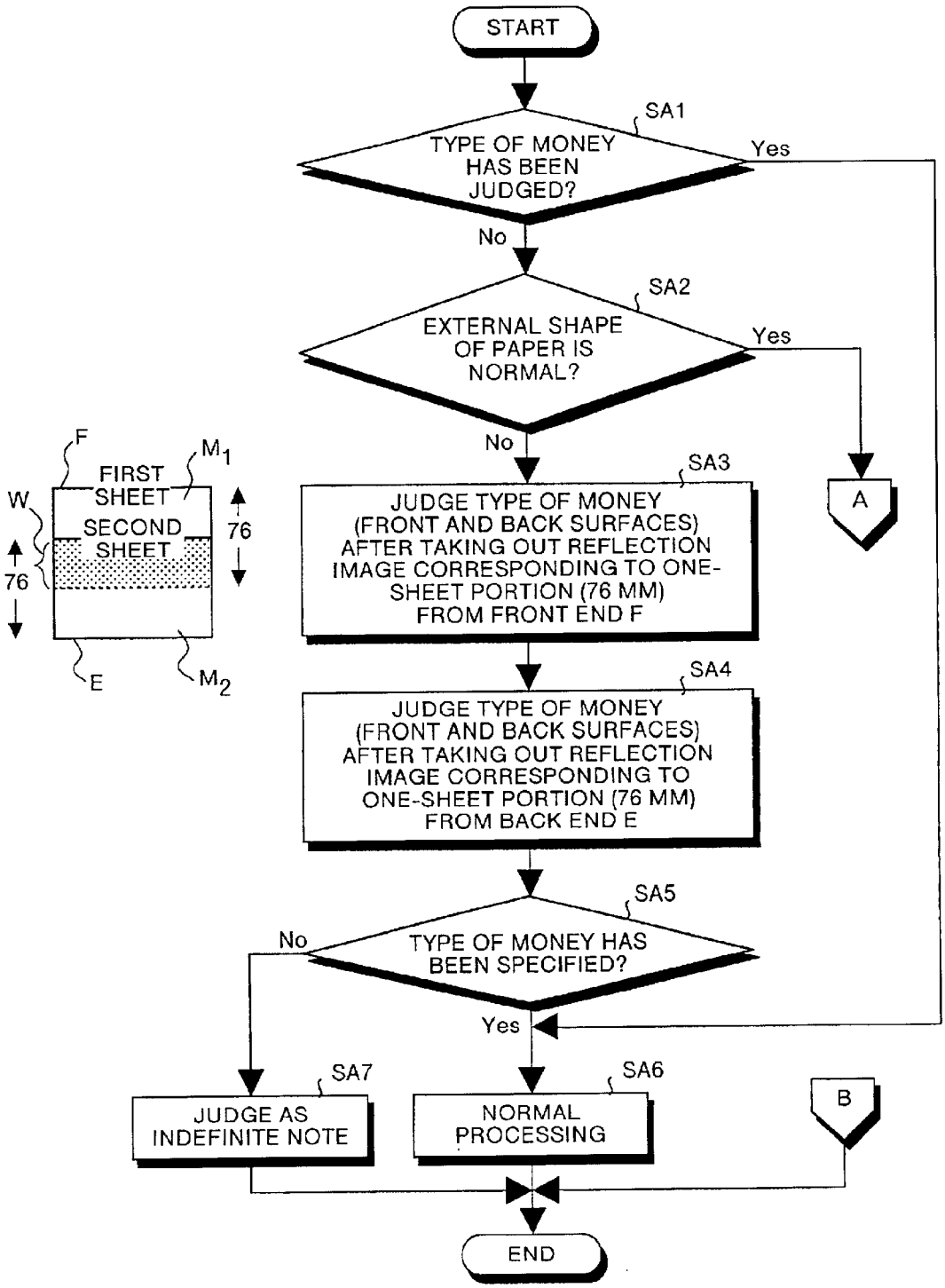
FIG. 10 is a flowchart which explains an operation example 1 of the embodiment.

On the other hand, when a result of the judgement made at step SA1 shown in FIG. 10 is "No", in other words, when a plurality of sheets of paper have been conveyed to the distinguishing unit 110 in a status that these sheets of paper are superimposed with each other, the central processing unit 210 proceeds to step SA2. At step SA2, the central processing unit 210 makes the type-of-money judging section 290 judge whether the external shape of the sheets of paper is normal or not. In other words, the type-of-money judging section 290 judges whether the external shape is normal or not, based on whether the length in the long-side direction and the length in the short-side direction of the image data (of the paper) from the image processing section 280 coincide with the length in the long-side direction and the length in the short-side direction of the dictionary data respectively.

Figure 11:
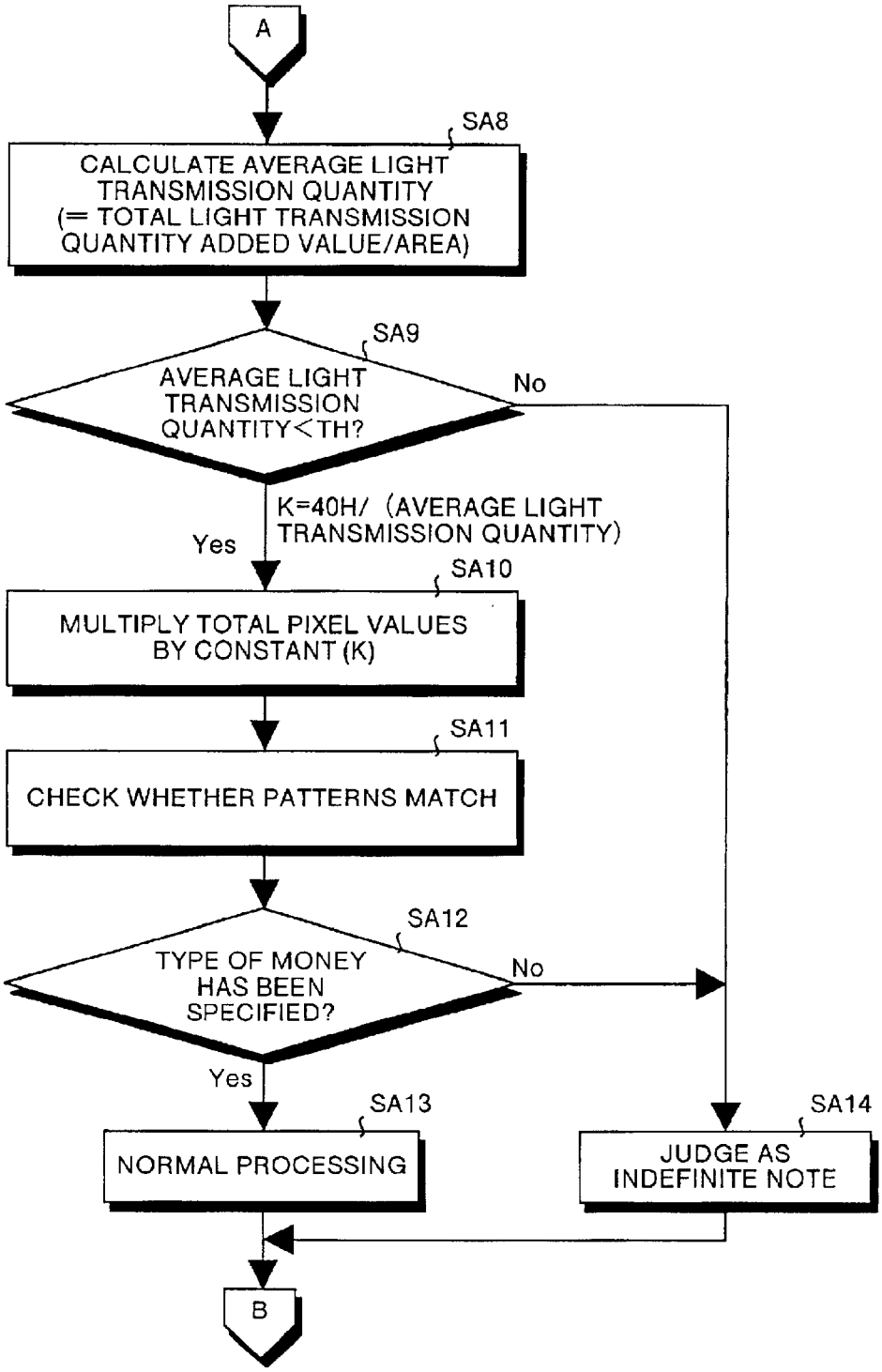
FIG. 11 is a flowchart which explains an operation example 1 of the embodiment.

When a plurality of sheets of paper are in a completely superimposed status, the type-of-money judging section 290 sets "Yes" as a result of the judgement made at step SA2, and proceeds to step SA8 shown in FIG. 11. At step SA8, the type-of-money judging section 290 divides the data of the added value of the whole light transmission quantities from the light transmission quantity adding section 270, by the area data of the paper included in the dictionary data, thereby to obtain an average light transmission quantity of the paper. Then, the type-of-money judging section 290 proceeds to step SA9. This average light transmission quantity is a light transmission quantity per unit area of the paper.

At step SA9, the type-of-money judging section 290 judges whether the average light transmission quantity obtained at step SA8 is smaller than a threshold value TH that has been set in advance or not. This threshold value TH is used to judge whether the average light transmission quantity is excessively small or not. In other words, when the average light transmission quantity is smaller than the threshold value TH, this means that the average light transmission quantity is extremely smaller than the average light transmission quantity of one clean sheet of paper, due to a complete superimposition of at least two sheets of paper or due to one stained sheet of paper.

When a result of the judgement made at step SA9 is "Yes", the type-of-money judging section 290 proceeds to step SA10. At step SA10, the type-of-money judging section 290 divides the average light transmission quantity obtained at step SA8 by a permissible average light transmission quantity (for example, 40H in 256 gradations), and obtains this result of the division as a constant K. The permissible average light transmission quantity is set at the time of the shipment, and this is a minimum value of the average light transmission quantity based on which it is possible to correctly judge the type of money. Next, the type-of-money judging section 290 multiplies the light transmission quantity for the whole pixels detected by the optical sensor 241, by the constant K, and obtains a sum of these multiplied results as a correction total light transmission quantity added value. Then, the type-of-money judging section 290 proceeds to step SA11.

At step SA11, the type-of-money judging section 290 judges a type of money of the paper M, by checking whether the pattern of the dictionary data that is stored in the dictionary data section 310 matches the pattern of the image data corresponding to the correction total light transmission quantity added value. The type-of-money judging section 290 outputs a result of judging the type of money to the central processing unit 210. At step SA12, the central processing unit 210 judges whether the type-of-money judging section 290 has been able to judge the type of money or not.

When the type-of-money judging section 290 has been able to judge the type of money, the central processing unit 210 sets "Yes" as a result of the judgement made at step SA12, and proceeds to step SA13. At step SA13, the central processing unit 210 executes the normal processing in a similar manner to that at step SA6. In other words, the central processing unit 210 instructs the original/imitation judging section 300 to start distinguishing the paper. Based on this, the original/imitation judging section 300 judges the original or an imitation of the paper M based on the dictionary data and the image data from the image processing section 280. When the paper M is the original note as a result of the original/imitation judgement, the number-of-sheet-of-paper collating section 320 collates the number of sheets of the paper M that have been taken out from the entering box 106, with the number of sheets based on the results of judgement by the type-of-money judging section 290 and the original/imitation judging section 300, and the number of sheets of paper that have been taken out from the entering box 106. The number-of-sheet-of-paper collating section 320 passes a result of the collation to the central processing unit 210. When the numbers of sheets of paper coincide with each other as a result of the collation, the central processing unit 210 updates the data relating to the type of money and the number of sheets of paper in the memory section 350, and finishes a series of judgement.

Figure 4:
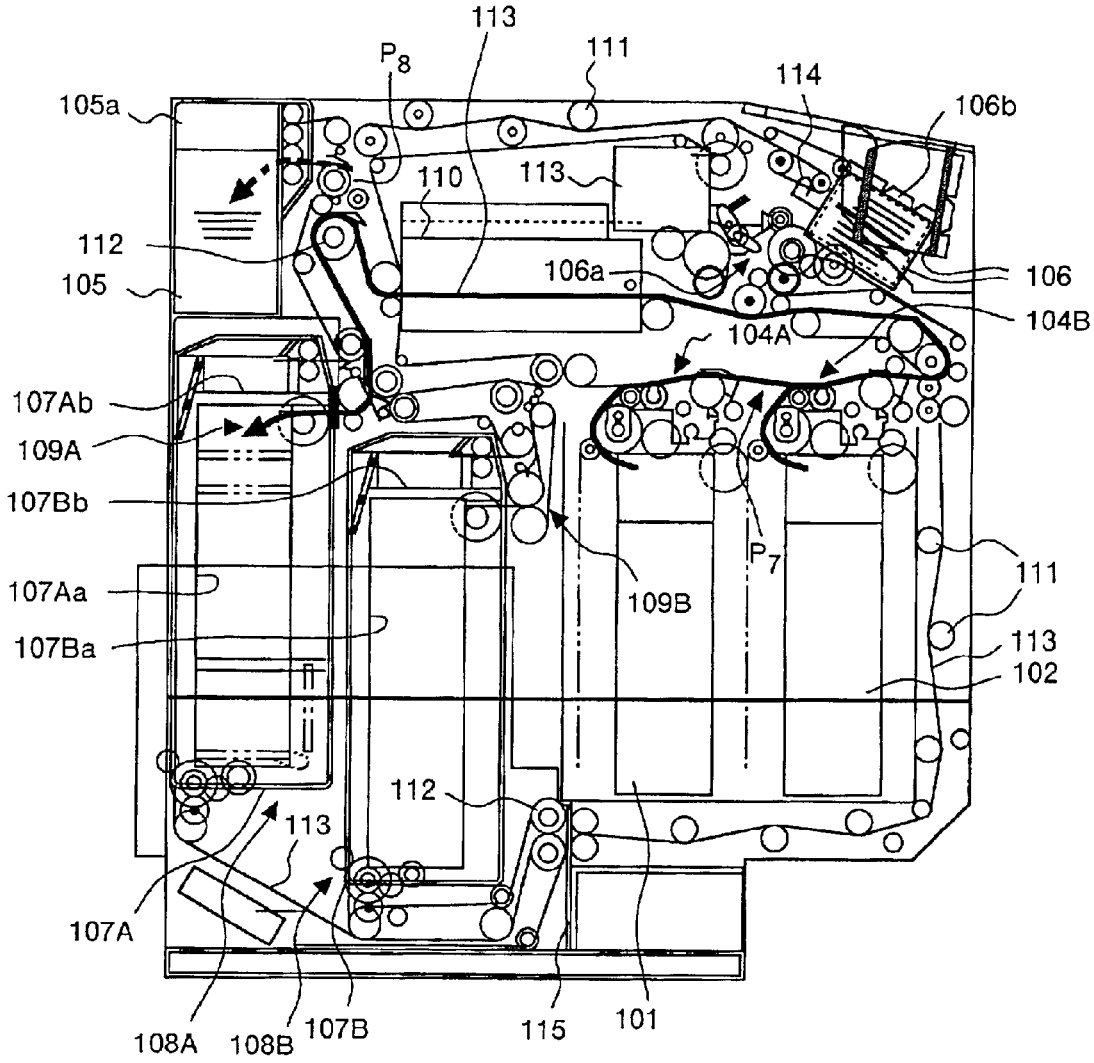
FIG. 4 is a side cross-sectional diagram which explains the operation in a note-recovery mode of the ATM shown in FIG. 1.

On the other hand, when the type-of-money judging section 290 has not been able to judge the type of money, the central processing unit 210 sets "No" as a result of the judgement made at step SA12, and proceeds to step SA14. A result of the judgement made at step SA12 becomes "No" in an extremely rare case in which the paper is extremely stained. At step SA14, the central processing unit 210 judges the paper as indefinite note, and finishes a series of judgement. When the distinguishing unit 110 has distinguished the paper as an indefinite note, this paper is accommodated in the rejection box 105 that is disposed at the left side of a branch point $P_8$, as shown in FIG. 4.

When a result of the judgement made at step SA2 shown in FIG. 10 is "No", the type-of-money judging section 290 proceeds to step SA3. A result of the judgement made at step SA2 becomes "No" when the paper distinguished by the distinguishing unit 110 is in a status that two sheets of paper $M_1$ and $M_2$ are partially superimposed at a portion of W, for example.

At step SA3, the type-of-money judging section 290 receives from the central processing unit 210 image data that corresponds to the reflection light from the optical sensor (refer to FIG. 6). This image data includes front surface image data corresponding to the front surfaces of the sheets of paper $M_1$ and $M_2$ that are in a superimposed status, and back surface image data corresponding to the back surfaces of the sheets of paper $M_1$ and $M_2$. The type-of-money judging section 290 takes out a reflection image of a portion corresponding to one sheet of paper (a portion corresponding to 76 mm in the short-side direction) from the front end F of the sheets of paper $M_1$ and $M_2$, from the front surface image data. The type-of-money judging section 290 then checks whether the pattern of the reflection image data matches the pattern of the dictionary data, thereby to judge the type of money.

Similarly, the type-of-money judging section 290 takes out a reflection image of a portion corresponding to one sheet of paper (a portion corresponding to 76 mm in the short-side direction) from the front end F of the sheets of paper $M_1$ and $M_2$, from the back surface image data. The type-of-money judging section 290 then checks whether the pattern of the reflection image data matches the pattern of the dictionary data, thereby to judge the type of money. Then, the type-of-money judging section 290 proceeds to step SA4.

At step SA4, type-of-money judging section 290 takes out a reflection image of a portion corresponding to one sheet of paper (a portion corresponding to 76 mm in the short-side direction) from the back end E of the sheets of paper $M_1$ and $M_2$, from the front surface image data. The type-of-money judging section 290 then checks whether the pattern of the reflection image data matches the pattern of the dictionary data, thereby to judge the type of money. Next, the type-of-money judging section 290 takes out a reflection image of a portion corresponding to one sheet of paper (a portion corresponding to 76 mm in the short-side direction) from the back end E of the sheets of paper $M_1$ and $M_2$, from the back surface image data. The type-of-money judging section 290 then checks whether the pattern of the reflection image data matches the pattern of the dictionary data, thereby to judge the type of money. Then, the type-of-money judging section 290 proceeds to step SA5.

As explained above, at step SA4 and at step SA5, the patterns of the superimposed sheets of paper $M_1$ and $M_2$ are checked whether they match the patterns of the dictionary data, based on four kinds of image data relating to the back surface. In the four-time checking of the match of the patterns, when the two sheets of paper are in the superimposed status, the type of money of the paper $M_2$, for example, is specified based on one of the reflection images that are taken out from the front surface image data. At the same time, the type of money of the paper $M_1$, for example, is specified based on the other reflection image taken out from the back surface image data.

At step SA5, the type-of-money judging section 290 judges whether the types of money of the superimposed sheets of notes have been specified or not.

When it has been possible to specify the types of money, the central processing unit 210 sets "Yes" as a result of the judgement made at step SA5, and proceeds to step SA6. The central processing unit 210 executes the normal processing in a similar manner to that explained above. In other words, the central processing unit 210 instructs the original/imitation judging section 300 to start distinguishing the paper. Based on this, the original/imitation judging section 300 judges the original or an imitation of the paper M based on the dictionary data and the image data from the image processing section 280. When the paper M is the original note as a result of the original/imitation judgement, the number-of-sheet-of-paper collating section 320 collates the number of sheets of the paper M that have been taken out from the entering box 106, with the number of sheets based on the results of judgement by the type-of-money judging section 290 and the original/imitation judging section 300, and the number of sheets of paper that have been taken out from the entering box 106. The number-of-sheet-of-paper collating section 320 passes a result of the collation to the central processing unit 210. When the numbers of sheets of paper coincide with each other as a result of the collation, the central processing unit 210 updates the data relating to the type of money and the number of sheets of paper in the memory section 350, and finishes a series of judgement.

On the other hand, when the type-of-money judging section 290 has not been able to judge the type of money, the central processing unit 210 sets "No" as a result of the judgement made at step SA5, and proceeds to step SA7. A result of the judgement made at step SA5 becomes "No" in an extremely rare case in which three or more sheets of paper are superimposed with each other. At step SA7, the central processing unit 210 judges the sheets of paper as indefinite notes, and finishes a series of judgement. When the distinguishing unit 110 has distinguished the paper as an indefinite notes, these sheets of paper are accommodated in the rejection box 105 that is disposed at the left side of a branch point $P_8$, as shown in FIG. 4.

Figure 2:
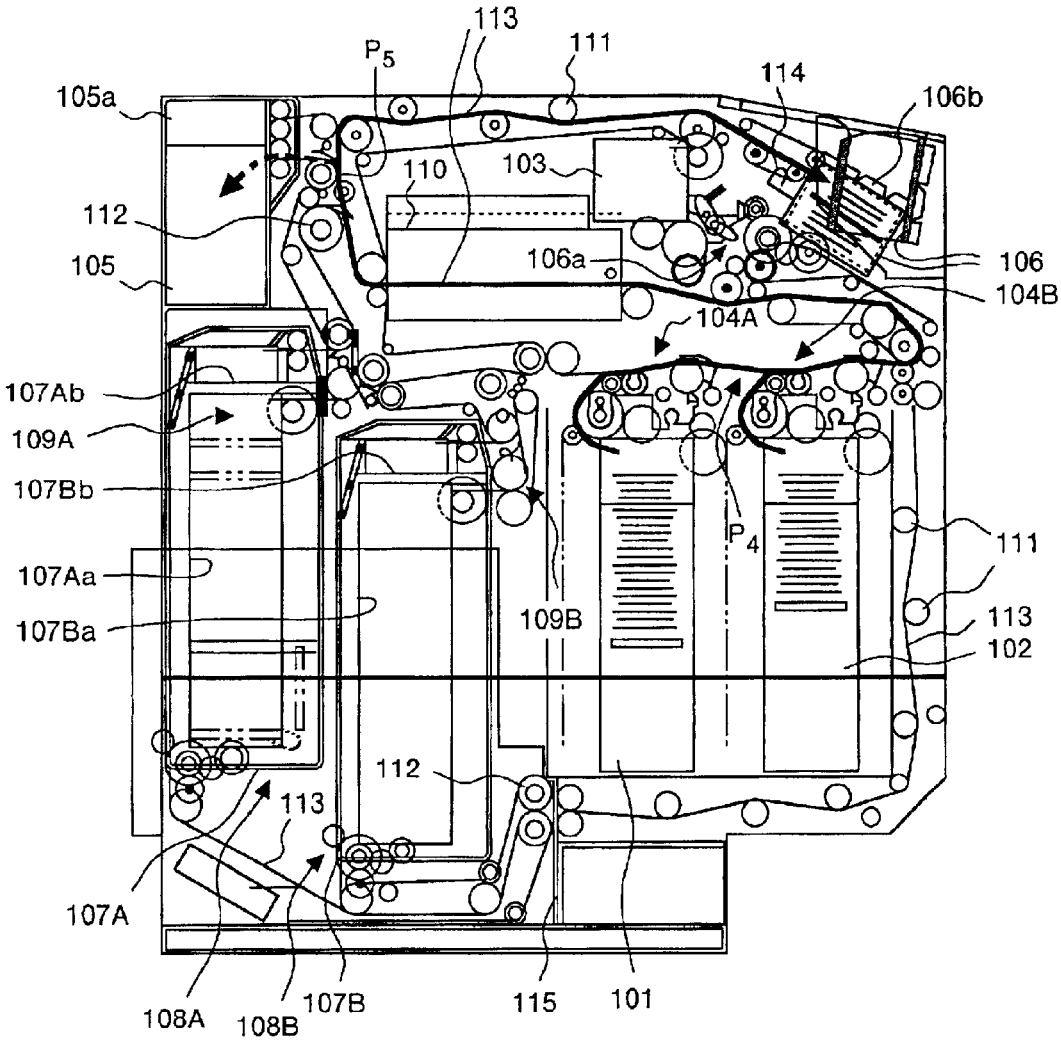
FIG. 2 is a side cross-sectional diagram which explains the operation in a note-reception mode of the ATM shown in FIG. 1.

In the note-payment mode, thousand-yen notes (or ten-thousand-yen notes) are conveyed from the thousand-yen stacker 101 (or the ten-thousand-yen stacker 102) to the entering box 106 via the conveying route shown by the thick line as shown in FIG. 2. Thousand-yen notes that have been taken out from the thousand-yen stacker 101 are conveyed to above a branch point $P_4$, and the distinguishing unit 110 distinguishes the thousand-yen notes. When the thousand-yen notes are the original as a result of the distinction, these thousand-yen notes are conveyed to the right side of a branch point $P_5$, and are taken out from the rejection box 106.

Figure 12:
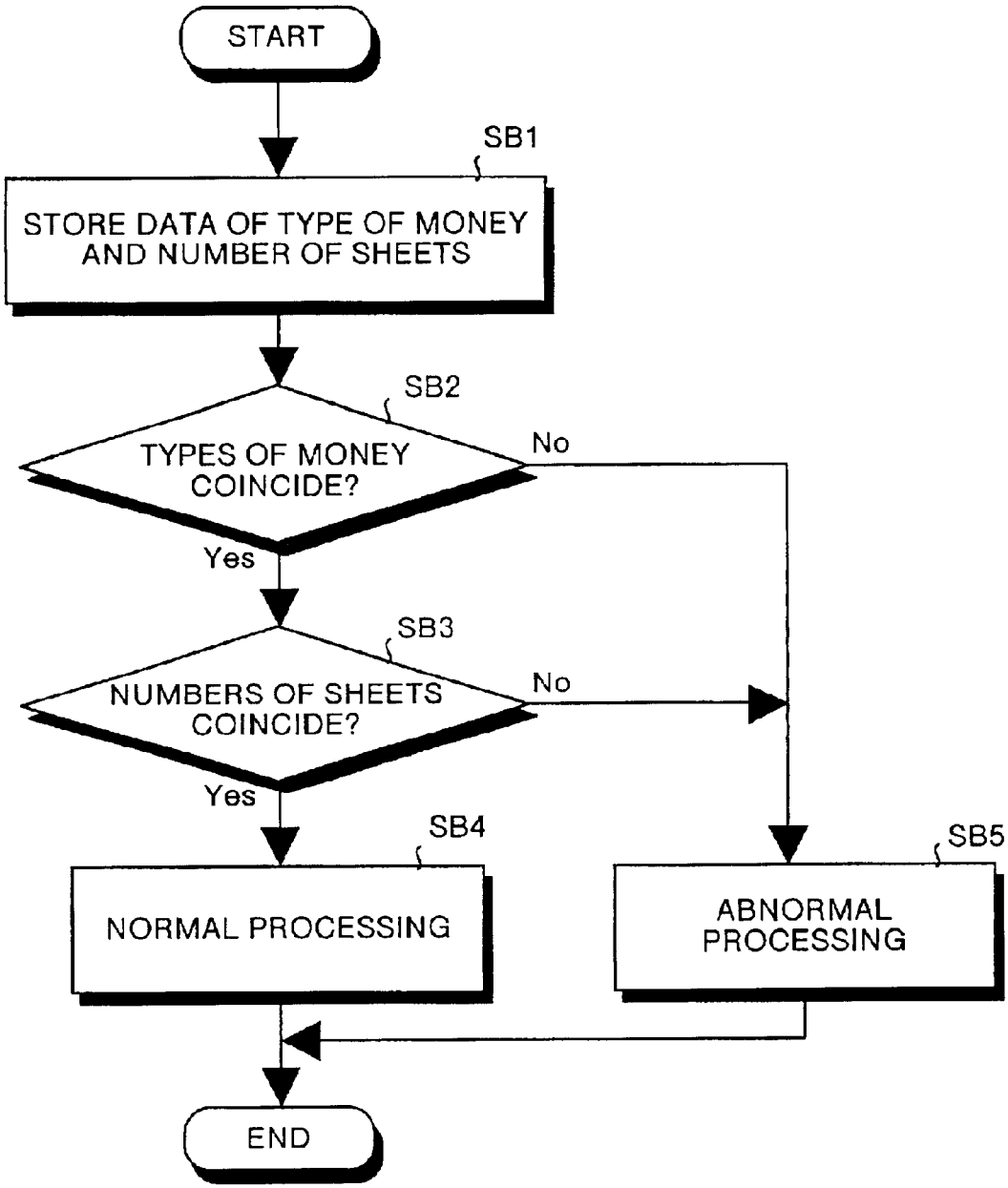
FIG. 12 is a flowchart which explains an operation example 1 of the embodiment.

In the example shown in FIG. 2, it is possible to execute the processing at step SB1 to step SB5 shown in FIG. 12 in place of the processing at step SA6 shown in FIG. 10 and step SA13 shown in FIG. 11. In other words, at step SB1 in FIG. 12, the central processing unit 210 instructs the original/imitation judging section 300 to start distinguishing the paper. Based on this, the original/imitation judging section 300 judges the original or an imitation of the paper M based on the dictionary data and the image data from the image processing section 280. When the paper M is the original note as a result of the original/imitation judgement, the original/imitation judging section 300 stores data relating the type and the number of sheets of paper, in the memory section 350.

At step SB2, the central processing unit 210 collates the type of money (a thousand-yen note) that has been taken out from the thousand-yen stacker 101, for example, with the type of money based on the results of judgement by the type-of-money judging section 290 and the original/imitation judging section 300. When the types of money coincide with each other as a result of the collation, the central processing unit 210 proceeds to step SB3. At step SB3, the central processing unit 210 collates the number of sheets of paper that have been taken out from the thousand-yen stacker 101, with the number of sheets based on the results of judgement by the type-of-money judging section 290 and the original/imitation judging section 300. When the numbers of sheets of paper coincide with each other as a result of the collation, the central processing unit 210 sets "Yes" as a result of the judgement made, and proceeds to step SB4. At step SB4, the central processing unit 210 executes the normal processing of conveying the distinguished notes to the entering box 106, and finishes a series of judgement.

On the other hand, when a result of the judgement made at step SB2 or step SB3 is "No", the central processing unit 210 executes the abnormal processing such as a notification of an alarm to the manager to inform the occurrence of an abnormal status, and finishes a series of judgement.

Figure 3:
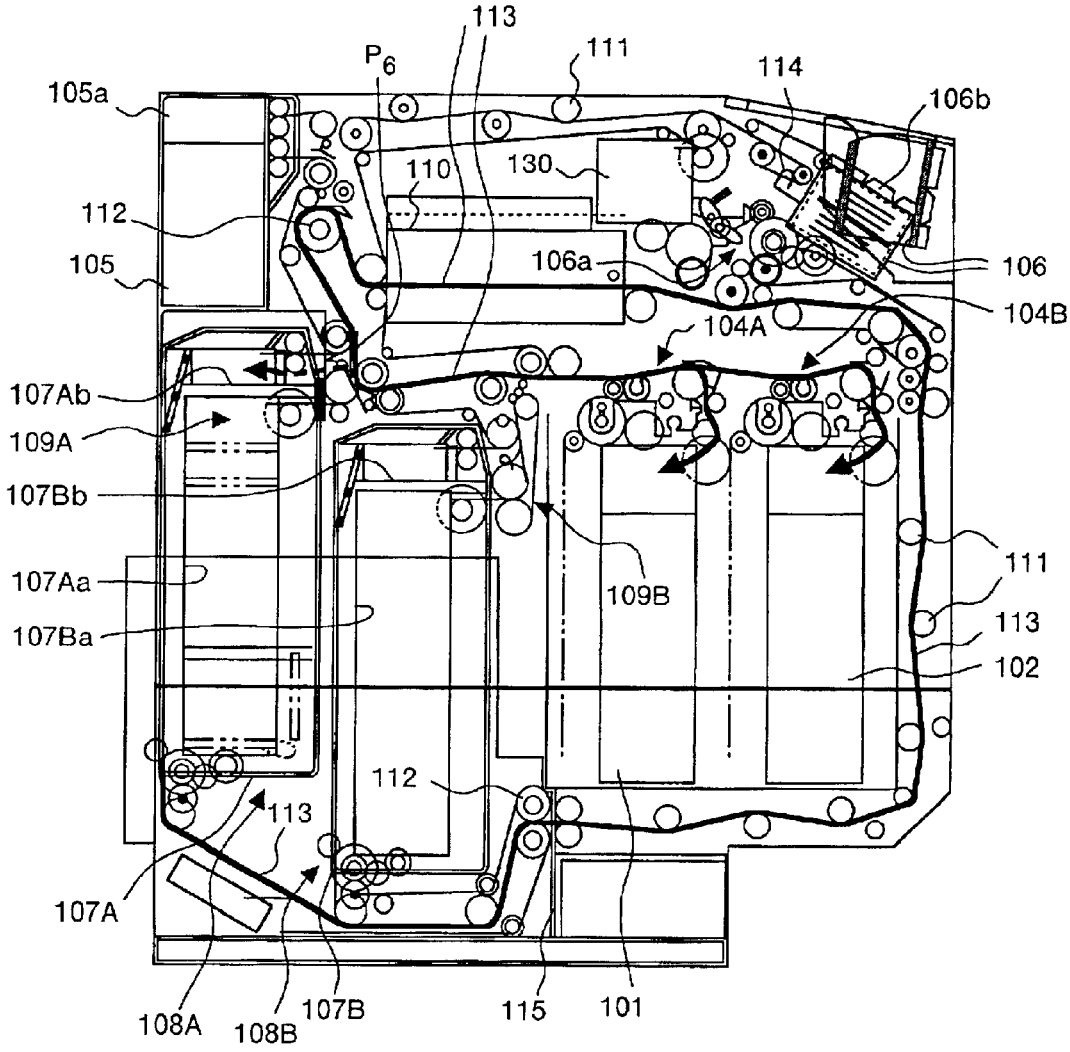
FIG. 3 is a side cross-sectional diagram which explains the operation in a note-replenishment mode of the ATM shown in FIG. 1.

It is also possible to apply the processing at step SB1 to step SB5 shown in FIG. 12 to the processing in the note-replenishment mode shown in FIG. 3 and the note-recovery mode shown in FIG. 4.

In the note-replenishment mode shown in FIG. 3, when the remaining quantity of notes in the thousand-yen stacker 101 or the ten-thousand-yen stacker 102 has become small, notes stored in the cassette 107A are conveyed to the thousand-yen stacker 101 or the ten-thousand-yen stacker 102 via the conveying route shown by the thick line in FIG. 3. In the middle of the conveyance of the notes, these notes are distinguished by the distinguishing unit 110. When a result of the judgement made at step SB2 or step SB3 shown in FIG. 12 is "No", these sheets of paper are rejected to the rejection chamber 107A*b* that is positioned at the left side of a branch point $P_6$.

In the note-recovery mode shown in FIG. 4, when the accommodation quantity of notes in the thousand-yen stacker 101 or the ten-thousand-yen stacker 102 has become equal to or above a prescribed quantity, the notes stored in the thousand-yen stacker 101 or the ten-thousand-yen stacker 102 are recovered in the cassette 107A via the conveying route shown by the thick line in FIG. 4. The ten-thousand-yen stacker 102 recovers ten-thousand-yen notes via a conveying route other than the conveying route at the left side of a branch point $P_7$. In the middle of the conveyance of the notes, these notes are distinguished by the distinguishing unit 110. When a result of the judgement made at step SB2 or step SB3 shown in FIG. 12 is "No", these sheets of paper are rejected to the rejection box 105 that is positioned at the left side of a branch point $P_8$.

Figure 13:
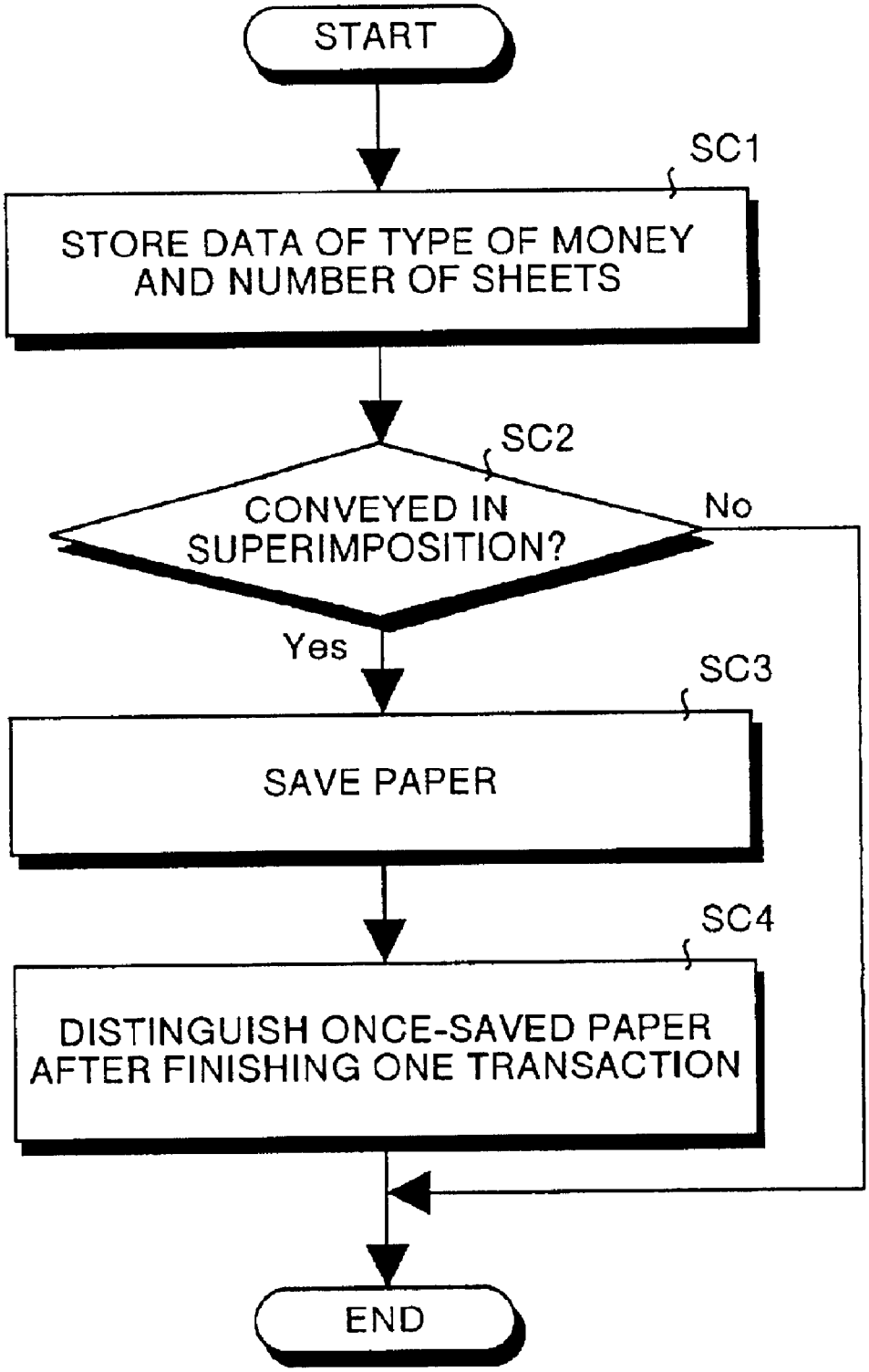
FIG. 13 is a flowchart which explains an operation example 1 of the embodiment.

It has been explained above that when a result of the judgement made at step SA5 shown in FIG. 10 or at step SA12 shown in FIG. 11 is "No", the sheets of paper are judged as indefinite notes. It is also possible to temporarily save the indefinite notes, and distinguish these indefinite notes again after one transaction has been finished. In this case, the processing at step SC1 to step SC4 shown in FIG. 13 is executed in place of the processing at step SA5 to step SA7 shown in FIG. 10 and at step SA12 to step SA14 shown in FIG. 11.

When three or more sheets of paper are superimposed with each other as a result of the distinction by the distinguishing unit 110 shown in FIG. 1 (the note-reception mode) or in FIG. 2 (the note-payment mode), a result of the judgement made at step SA2 in FIG. 10 becomes "No". The processing is executed at step SA3 and step SA4. Then, at step SC1 shown in FIG. 13, the central processing unit 210 stores into the memory section 350, the data relating to the type of money and the number of sheets that are a result of the distinction by the type-of-money judging section 290 and the original/imitation judging section 300. The central processing unit 210 proceeds to step SC2. The data relating to the type of money and the number of sheets stored in the memory section 350 is indefinite.

At step SC2, the central processing unit 210 judges whether a plurality of sheets of paper have been conveyed in a superimposed status or not. In this case, the central processing unit 210 sets "Yes" as a result of the judgement made, and proceeds to step SC3. At step SC3, the central processing unit 210 temporarily saves sheets of paper (in this case, three sheets of paper superimposed with each other) from the distinguishing unit 110 into the five-thousand-yen note box 103, for example, and proceeds to step SC4. In this case, the mode is either the note-reception mode or the note-payment mode, and the entering box 106, the thousand-yen stacker 101, and the ten-thousand-yen stacker 102 are being used. Therefore, the five-thousand-yen note box 103 is selected as a temporary save destination of the notes.

At step SC4, the central processing unit 210 sets the re-distinction mode to the re-distinction execution judging section 330. When one transaction relating to note-reception or note-payment has been finished, the re-distinction execution judging section 330 makes the temporarily-stored notes (three sheets of paper superimposed with each other) to be taken out from the five-thousand-yen box 103. There is a very high probability that the three sheets of paper are taken out sequentially one by one. When the three sheets of paper pass sequentially one by one within the distinguishing unit 110, the re-distinction is carried out, and types of money and the number of sheets of paper are judged in a similar manner to that explained above. In other words, based on the re-distinction, it is possible to accurately judge types of money and the number of sheets. Next, the central processing unit 210 stores the accurate data relating to the types of money and the number of sheets into the memory section 350.

In other words, when three or more sheets of paper are completely superimposed with each other as a result of the distinction by the distinguishing unit 110 shown in FIG. 1 (the note-reception mode) or in FIG. 2 (the note-payment mode), a result of the judgement made at step SA2 in FIG. 10 becomes "Yes", as explained above. The processing is executed at step SA8 and step SA11 shown in FIG. 11. Then, at step SC1 shown in FIG. 13, the central processing unit 210 stores into the memory section 350, the data relating to the type of money and the number of sheets that are a result of the distinction by the type-of-money judging section 290 and the original/imitation judging section 300. The central processing unit 210 proceeds to step SC2. The data relating to the type of money and the number of sheets stored in the memory section 350 is indefinite.

At step SC2, the central processing unit 210 judges whether a plurality of sheets of paper have been conveyed in a superimposed status or not. In this case, the central processing unit 210 sets "Yes" as a result of the judgement made, and proceeds to step SC3. The central processing unit 210 executes the processing at step SC3 and step SC4. The central processing unit 210 temporarily saves sheets of paper (in this case, three sheets of paper superimposed with each other) into the five-thousand-yen note box 103, in a similar manner to that explained above. After one transaction has been finished, it is possible to accurately judge types of money and the number of sheets. When a result of the judgement made at step SC2 shown in FIG. 13 is "No", a series of processing relating to the distinction is finished as normal.

It has been explained that, at step SC3 shown in FIG. 13, sheets of paper are temporarily stored in the five-thousand-yen box 103 in the note-reception mode shown in FIG. 1 or in the note-payment mode shown in FIG. 2. In the case of the note-replenishment mode shown in FIG. 3 or in the not-recovery mode shown in FIG. 4, sheets of paper are temporarily stored in the entering box 106. As a modified example, sheets of paper may be temporarily stored in the thousand-yen note stacker 101 or the ten-thousand-yen note stacker 102.

Next, an operation example 2 of one embodiment will be explained below with reference to flowcharts shown in FIG. 14 and FIG. 15. In this operation example 2, the precision of making judgement of the number and types of money is increased for sheets of paper that are conveyed in a superimposed status, by using both the optical sensor 241 and the thickness sensor 242 shown in FIG. 6.

Referring to FIG. 1, when a customer has entered bank notes into the entering box 106, the take-out mechanism 106*a* takes out the sheets of bank notes, and the conveying belt 113 conveys the bank notes toward the distinguishing unit 110. When the rush sensor 230 has detected the paper as shown in FIG. 6, the central processing unit 210 shown in FIG. 5 controls each section of the sensor section 240 to detect the transmission light, the reflection light, and the thickness of the paper respectively in a similar manner to that explained above.

The optical sensor 241 detects in one line unit the transmission light and the reflection light of the paper that is being conveyed. The optical sensor 241 outputs a result of the detection to the amplifier section 250 and the central processing unit 210. When the paper has been conveyed to a lower position of the displacement roller 243, the displacement roller 243 is displaced to the z direction according to the thickness of the paper.

The thickness detecting section 244*a* and the thickness detecting section 244*b* detect this displacement. Results of the detection by the thickness detecting section 244*a* and the thickness detecting section 244*b* are input to the sampling circuit 245 respectively. The sampling circuit 245 outputs the thickness sensor output values corresponding to the thickness of the paper to the central processing unit 210.

The amplifier section 250 amplifies the output signals from the first optical sensor 241*a* and the second optical sensor 241*b* respectively, and the A/D converting section 260 converts these output signals into digital data. The light transmission quantity adding section 270 adds light transmission quantities in one pixel unit corresponding to the image data from the A/D converting section 260 for the whole pixels. Next, the image processing section 280 carries out image processing like an inclination correction (a coordinate conversion) processing and a normalization processing of the image data from the light transmission quantity adding section 270.

Next, the type-of-money judging section 290 judges a type of money of the paper, by checking whether the pattern of the dictionary data that is stored in the dictionary data section 310 matches the pattern of the image data from the image processing section 280. The type-of-money judging section 290 outputs a result of judging the type of money to the central processing unit 210. The central processing unit 210 proceeds to step SD1 shown in FIG. 14, and judges whether the type-of-money judging section 290 has been able to judge the type of money or not.

Figure 15:
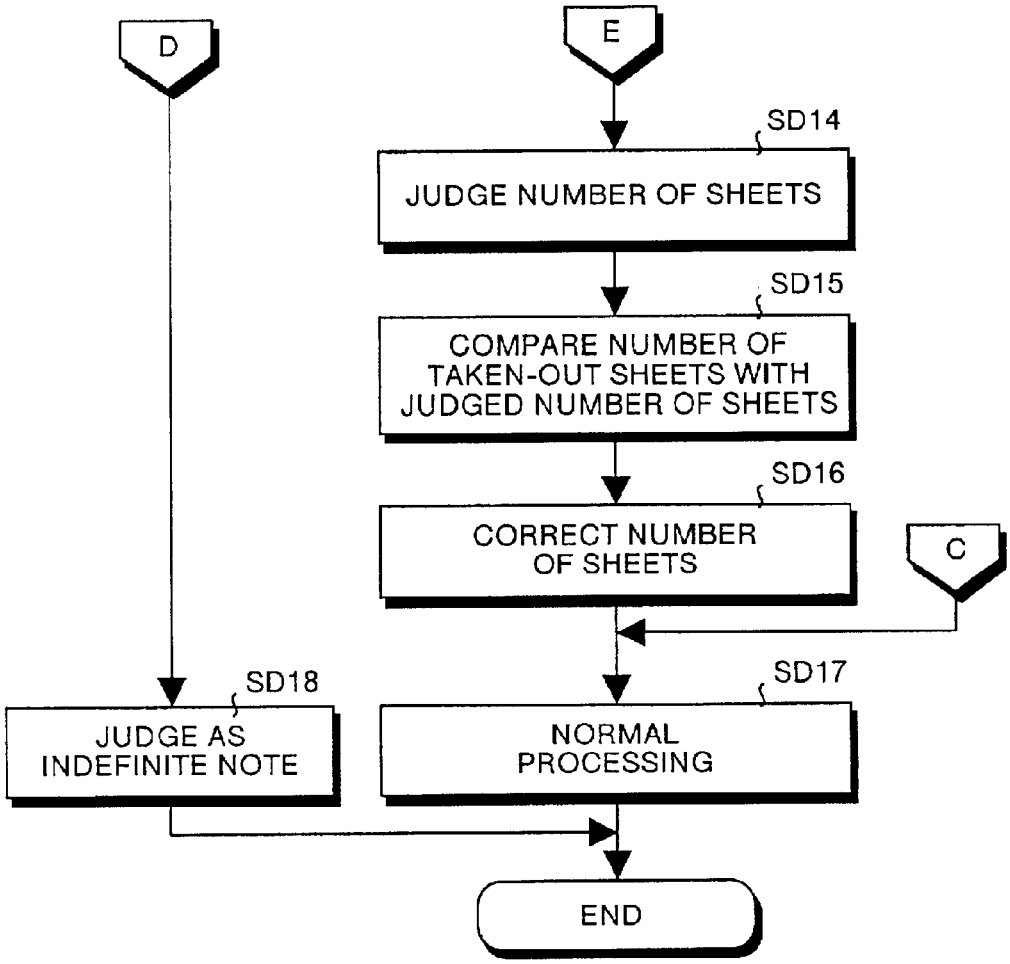
FIG. 15 is a flow chart which explains an operation example 2 of the embodiment.

When the type-of-money judging section 290 has been able to judge the type of money, the central processing unit 210 proceeds to step SD17 shown in FIG. 15, and executes the normal processing in a similar manner to that at step SA6 (refer to FIG. 10).

Figure 14:
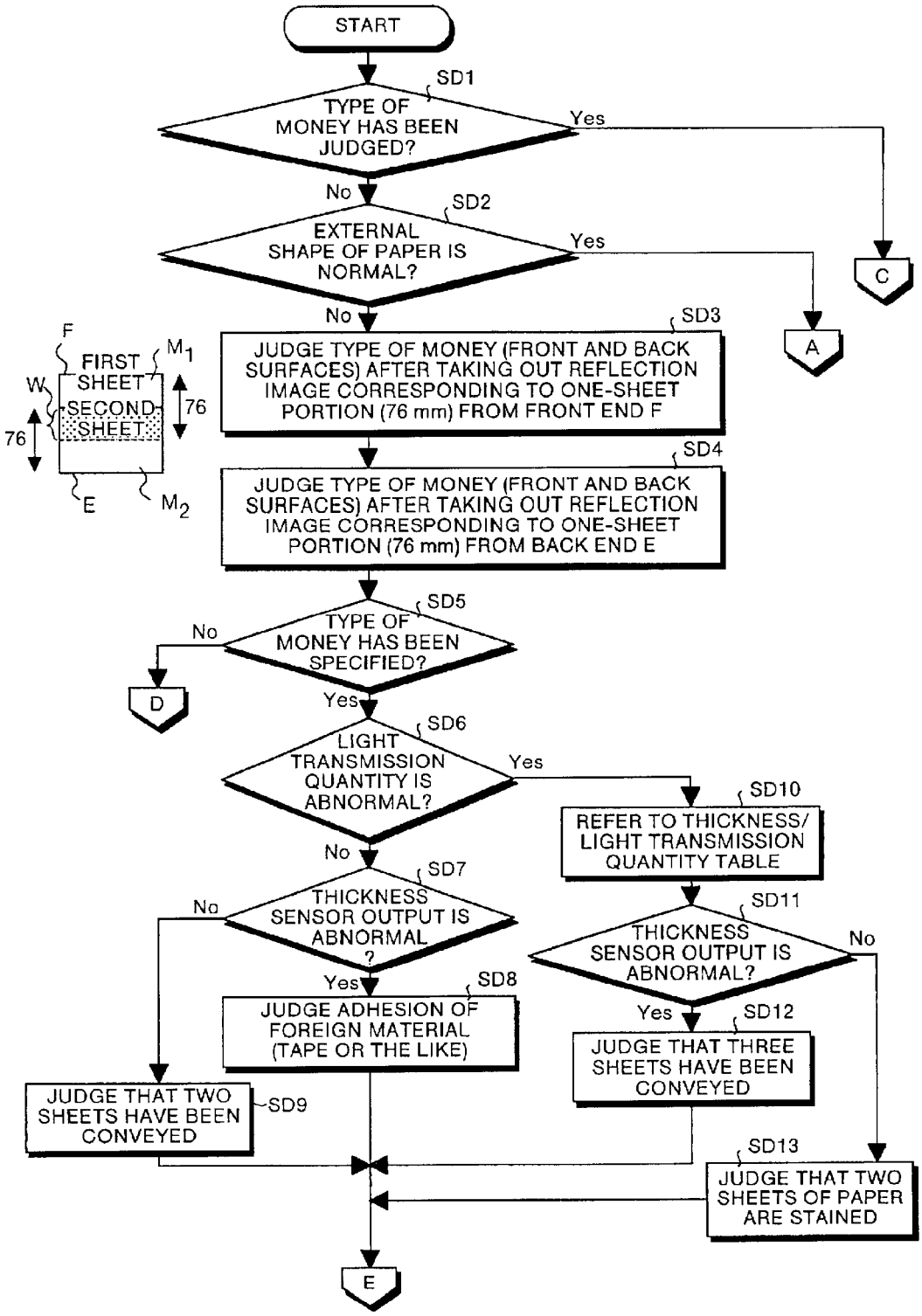
FIG. 14 is a flowchart which explains an operation example 2 of the embodiment.

On the other hand, when a result of the judgement made at step SD1 shown in FIG. 14 is "No", in other words, when a plurality of sheets of paper have been conveyed to the distinguishing unit 110 in a status that these sheets of paper are superimposed with each other, the central processing unit 210 proceeds to step SD2. At step SD2, the central processing unit 210 makes the type-of-money judging section 290 judge whether the external shape of the sheets of paper is normal or not. In other words, the type-of-money judging section 290 judges whether the external shape is normal or not, based on whether the length in the long-side direction and the length in the short-side direction of the image data (of the paper) from the image processing section 280 coincide with the length in the long-side direction and the length in the short-side direction of the dictionary data respectively.

When a plurality of sheets of paper are in a completely superimposed status, the type-of-money judging section 290 sets "Yes" as a result of the judgement made at step SD2, and proceeds to step SA8 shown in FIG. 11. Thereafter, the processing at step SA8 to step SA14 shown in FIG. 11 is executed.

When a result of the judgement made at step SD2 is "No", the type-of-money judging section 290 proceeds to step SD3. A result of the judgement made at step SD2 becomes "No" when the paper distinguished by the distinguishing unit 110 is in a status that two sheets of paper $M_1$ and $M_2$ are partially superimposed at a portion of W, or when a foreign material (like a tape) has been adhered to the paper.

At step SD3, the type-of-money judging section 290 receives from the central processing unit 210 image data that corresponds to the reflection light from the optical sensor (refer to FIG. 6), in a similar manner to that at step SA3 (refer to FIG. 10). This image data includes front surface image data corresponding to the front surfaces of the sheets of paper $M_1$ and $M_2$ that are in a superimposed status, and back surface image data corresponding to the back surfaces of the sheets of paper $M_1$ and $M_2$. The type-of-money judging section 290 takes out a reflection image of a portion corresponding to one sheet of paper (a portion corresponding to 76 mm in the short-side direction) from the front end F of the sheet of paper $M_1$ and the sheet of paper $M_2$, from the front surface image data. The type-of-money judging section 290 then checks whether the pattern of the reflection image data matches the pattern of the dictionary data, thereby to judge the type of money.

Similarly, the type-of-money judging section 290 takes out a reflection image of a portion corresponding to one sheet of paper (a portion corresponding to 76 mm in the short-side direction) from the front end F of the sheets of paper $M_1$ and $M_2$, from the back surface image data. The type-of-money judging section 290 then checks whether the pattern of the reflection image data matches the pattern of the dictionary data, thereby to judge the type of money. Then, the type-of-money judging section 290 proceeds to step SD4.

At step SD4, type-of-money judging section 290 takes out a reflection image of a portion corresponding to one sheet of paper (a portion corresponding to 76 mm in the short-side direction) from the back end E of the sheets of paper $M_1$ and $M_2$, from the front surface image data, in a similar manner to that at step SA4 (refer to FIG. 10). The type-of-money judging section 290 then checks whether the pattern of the reflection image data matches the pattern of the dictionary data, thereby to judge the type of money. Next, the type-of-money judging section 290 takes out a reflection image of a portion corresponding to one sheet of paper (a portion corresponding to 76 mm in the short-side direction) from the back end E of the sheets of paper $M_1$ and $M_2$, from the back surface image data. The type-of-money judging section 290 then checks whether the pattern of the reflection image data matches the pattern of the dictionary data, thereby to judge the type of money. Then, the type-of-money judging section 290 proceeds to step SD5.

At step SD5, the type-of-money judging section 290 judges whether the types of money of the superimposed sheets of notes have been specified or not. When it has been possible to specify the types of money, the central processing unit 210 sets "Yes" as a result of the judgement made at step SD5, and proceeds to step SD6. When a result of the judgement made at step SD5 is "No", the central processing unit 210 proceeds to step SD18 shown in FIG. 15, and judges that the paper is an indefinite note, in a similar manner to that at step SA7 (refer to FIG. 10).

Figure 9:
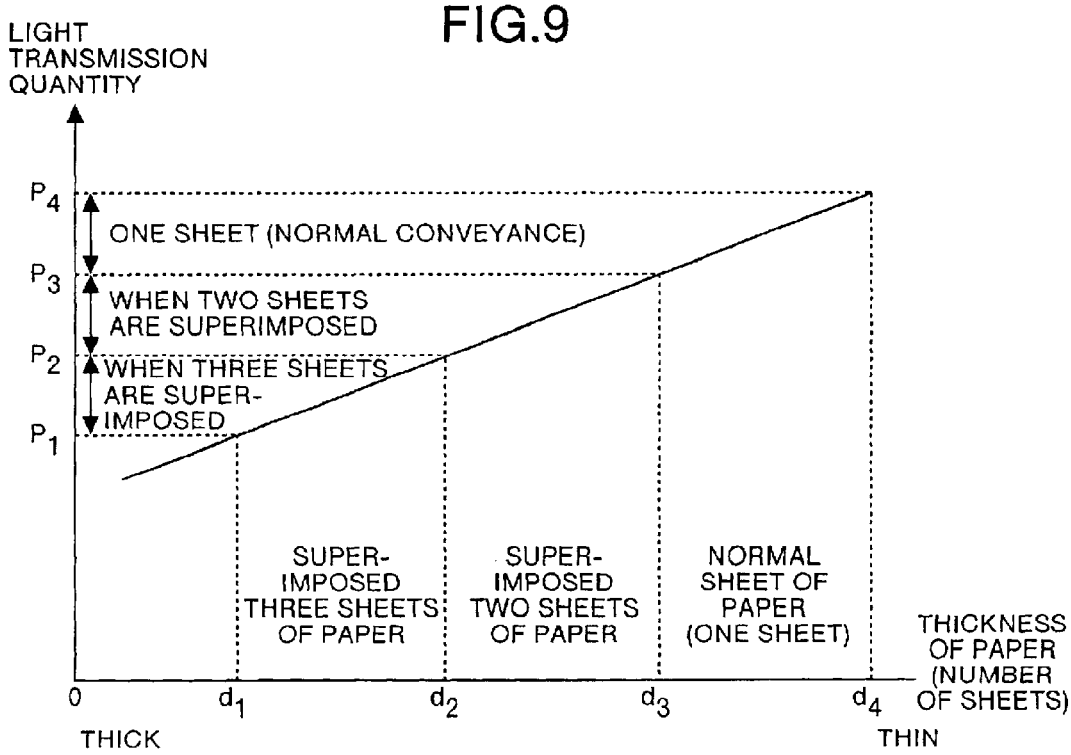
FIG. 9 is a diagram showing a relationship between a thickness (a number of sheets) of paper and a light transmission quantity in the embodiment.

At step SD6, the central processing unit 210 judges whether the light transmission quantity from the optical sensor 241 is abnormal or not. Specifically, the central processing unit 210 judges whether the light transmission quantity from the optical sensor 241 is less than a light transmission quantity $P_2$ shown in FIG. 9 or not. In other words, the central processing unit 210 judges whether the number of sheets of paper is at least three or not. FIG. 9 shows a relationship between a light transmission quantity and a thickness (a number of sheets) of paper.

In this drawing, light transmission quantities $P_1$ to $P_4$ correspond to thickness $d_1$ to $d_4$ (number of sheets) of paper respectively. Therefore, when the light transmission quantity from the optical sensor 241 is applied to the data shown in this drawing, it is possible to know the number of sheets of paper from this light transmission quantity. The data shown in FIG. 9 is obtained based on experiments, and this data is held in a memory (not shown) of the central processing unit 210 as a thickness/light transmission quantity table.

When the light transmission quantity from the optical sensor 241 is equal to or above the light transmission quantity $P_2$ and less than $P_3$, the central processing unit 210 sets "No" as a result of the judgement made at step SD6, and proceeds to step SD7.

Figure 8:
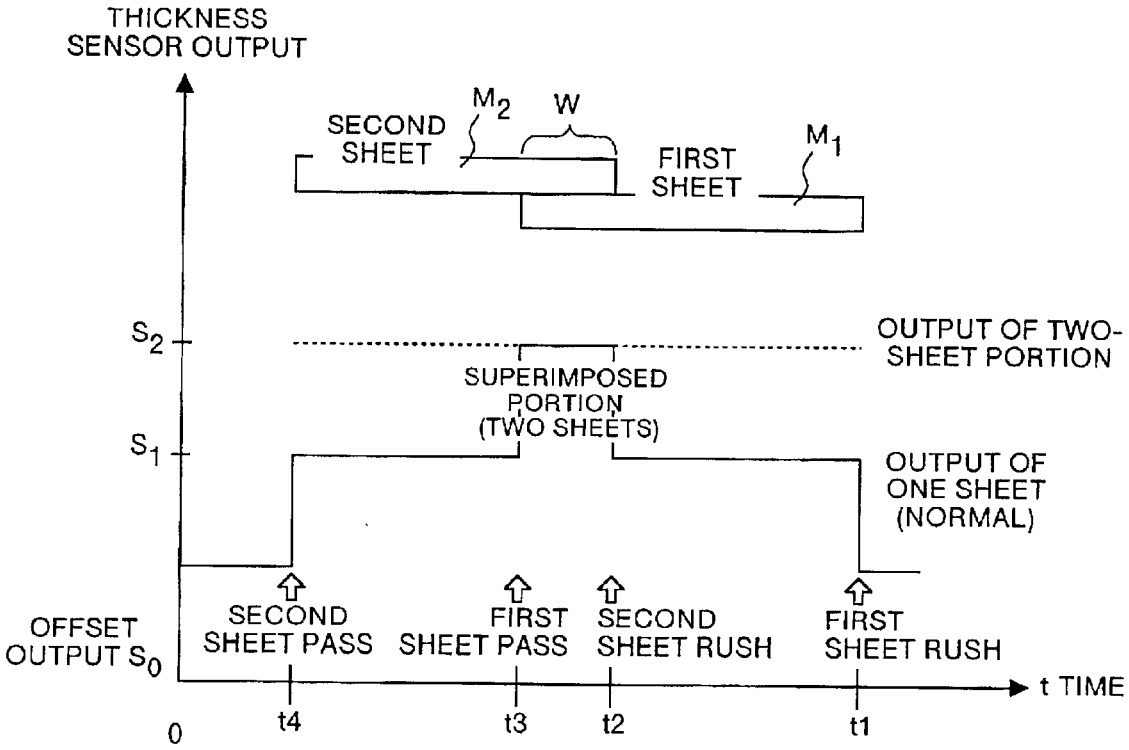
FIG. 8 is a diagram showing a change in a thickness sensor output of the sensor section 240 shown in FIG. 6.

At step SD7, the central processing unit 210 judges whether a thickness sensor output (refer to FIG. 6) as a result of the detection of the thickness sensor 242 is abnormal or not. Specifically, the central processing unit 210 judges whether the thickness sensor output is equal to or above a thickness sensor output $S_2$ shown in FIG. 8 or not. In other words, the central processing unit 210 judges whether the number of sheets of paper is at least three or not. FIG. 8 shows a relationship between a thickness sensor output and a number of sheets of paper.

In this drawing, an offset output $S_0$ is a value that shows that paper has not been detected by the thickness sensor 242. A thickness sensor output $S_1$ is a value that shows that the thickness sensor 242 has detected a thickness of one sheet of paper (in this drawing, a portion at which the sheets of paper $M_1$ and the sheet of paper $M_2$ are not superimposed with each other). A thickness sensor output S2 is a value that shows that the thickness sensor 242 has detected a thickness of two sheets of paper (in this drawing, a portion W at which the sheets of paper $M_1$ and the sheet of paper $M_2$ are superimposed with each other)

When the thickness sensor output is equal to or above the thickness sensor output $S_1$ and less than S2 shown in FIG. 8, the central processing unit 210 sets "No" as a result of the judgment made at step SD7, and proceeds to step SD9. At step SD9, the central processing unit 210 judges that two sheets of paper have been conveyed, and proceeds to step SD14 shown in FIG. 15.

On the other hand, when the thickness sensor output is equal to or above the thickness sensor output S2 shown in FIG. 8, the central processing unit 210 sets "Yes" as a result of the judgment made at step SD7, and proceeds to step SD8.

At step SD8, the central processing unit 210 judges that a foreign material (such as a tape) has been adhered to the paper, and proceeds to step SD14 shown in FIG. 15.

When a result of the judgement made at step SD6 is "Yes", the central processing unit 210 proceeds to step SD10. At step SD10, the central processing unit 210 refers to the thickness/light transmission quantity table (refer to FIG. 9), and checks the relationship between the light transmission quantity from the optical sensor 241 and the thickness for the whole surfaces of the sheets of paper, and proceeds to step SD11.

At step SD11, the central processing unit 210 judges whether a thickness sensor output (refer to FIG. 6) as a result of the detection of the thickness sensor 242 is abnormal or not, in a similar manner to that at step SD7. Specifically, the central processing unit 210 judges whether the thickness sensor output is equal to or above a thickness sensor output S2 shown in FIG. 8 or not. In other words, the central processing unit 210 judges whether the number of sheets of paper is at least three or not. When a result of the judgement made at step SD11 is "Yes", the central processing unit 210 proceeds to step SD12.

At step SD12, the central processing unit 210 judges that three or more sheets of paper have been conveyed in a superimposed status, and the central processing unit 210 proceeds to step SD14 shown in FIG. 15. On the other hand, when a result of the judgement made at step SD11 is "No", the central processing unit 210 proceeds to step SD13. At step SD13, the central processing unit 210 judges that stained two sheets of paper have been conveyed in a superimposed status, and the central processing unit 210 proceeds to step SD14 shown in FIG. 15.

At step SD14, the central processing unit 210 judges that a result of the judgement made at step SD9, step SD8, step SD12, or step SD13 is the number of sheets of paper, and proceeds to step SD15. At step SD15, the central processing unit 20 compares the number of sheets of paper that have been taken out from the take-out mechanism 106*a* shown in FIG. 1 with the number of sheets of paper judged at step SD14, and then proceeds to step SD16.

When the number of sheets of paper coincide with each other as a result of the comparison carried out at step SD15, the central processing unit 210 corrects (updates), at step SD16, the data of the number of sheets stored in the memory section 350, by controlling the correcting section 340. Then, the central processing unit 210 proceeds to step SD17. At step SD17, the central processing unit 210 executes the normal processing in a similar manner to that at step SA6 (refer to FIG. 10), and finishes a series of the processing.

As explained above, according to the one embodiment, when the light transmission quantity relating to the paper to be distinguished is lower than a light transmission quantity threshold value, this light transmission quantity is corrected, as explained with reference to FIG. 11. Therefore, even when a plurality of sheets of paper are in a completely superimposed status, it is possible to improve the precision in judging the types of money and the number of sheets of banknotes. It is also possible to execute the smooth operation.

Further, according to the one embodiment, when the external shape of the paper to be distinguished does not coincide with the prescribed shape, the types of money and the number of sheets of paper are distinguished based on the light reflection quantity on the front and back surfaces of the sheets of paper respectively, as explained with reference to FIG. 10. Therefore, even when at least two sheets of paper are in a partly superimposed status, it is possible to distinguish the types of money and the number of sheets in high precision.

Further, according to the one embodiment, the central processing unit 210 or the correcting section 340 updates the data relating to the types of money and the number of sheets of paper stored in the memory section 350, based on the types of money and the number of sheets of paper that have been conveyed in a superimposed status. Therefore, it is always possible to accurately understand the types of money and the number of sheets of paper that are held in the ATM.

Further, according to the one embodiment, it is possible to lower the rejection rate at which the sheets of paper are processed as indefinite notes than the rejection rate according to the conventional practice. Therefore, it is possible to effectively solve the above problems of the unattended ATM operation.

Further, according to the one embodiment, the central processing unit 210 or the number-of-sheet-of-paper collating section 320 updates the data stored in the memory section 350, based on the result of the collation between the number of sheets of paper that have been actually taken out and the number of sheets of paper that have been distinguished by the type-of-money judging section 290 and the original/imitation judging section 300. Therefore, it is possible to improve the reliability of the data.

Further, according to the one embodiment, the sheets of paper that have been conveyed in a superimposed status are saved temporarily, and these sheets of paper are conveyed again and are distinguished again, as explained with reference to FIG. 13. Therefore, it is possible to increase the probability that the superimposed sheets of paper are taken out sequentially one by one. As a result, it is possible to improve the precision in judging the types of money and the number of sheets of paper.

Further, according to the one embodiment, sheets of paper are distinguished based on three elements including the light reflection quantity, the light transmission quantity, and the result of the detection by the thickness sensor 242. Therefore, when it is not possible to carry out the distinction based on only one element, it becomes possible to achieve the distinction based on other elements. As a result, it is possible to distinguish the types and the number of sheets of paper in high precision.

As explained above, according to the present invention, when the light transmission quantity of the sheets of paper to be distinguished is lower than the light transmission quantity threshold value, the light transmission quantity is corrected. Therefore, there is an effect that even when the plurality of sheets of paper are completely in a superimposed status, it is possible to improve the precision in judging the types and the number of sheets of paper, and it is possible to carry out a smooth operation.

Further, according to the present invention, when the external shape of the sheets of paper to be distinguished does not coincide with the prescribed shape, the types of money and the number of sheets of paper are distinguished based on the light reflection quantity on the front and back surfaces of the sheets of paper. Therefore, there is an effect that even when two sheets of paper have been conveyed in a status that a part of a sheet of paper is superimposed with the other sheet, it is possible to distinguish in high precision.

Further, according to the present invention, the data updating unit updates data stored in the memory unit, based on the types and the number of sheets of paper conveyed in a superimposed status. Therefore, there is an effect that it is always possible to accurately understand the types and the number of sheets of paper stored in the apparatus.

Further, according to the present invention, the number-of-sheets-of-paper collating unit updates the data, based on a result of the collation between the number of sheets of paper actually taken out by the conveying unit and the number of sheets of paper distinguished by the distinguishing unit. Therefore, there is an effect that it is possible to improve the reliability of the data.

Further, according to the present invention, the sheets of paper that have been conveyed in a superimposed status are temporarily saved, and they are conveyed again and distinguished again. Therefore, it is possible to increase the probability that the sheets of paper are sequentially taken out one by one from the superimposed status. As a result, there is an effect that it is possible to improve the precision in judging the types of money and judging the number of sheets of paper.

Further, according to the present invention, the distinction is carried out based on the three elements, including the light reflection quantity, the light transmission quantity, and the result of the detection by the thickness detecting unit. Therefore, when it is not possible to carry out the distinction based on only one element, it becomes possible to achieve the distinction based on other elements. As a result, there is an effect that it is possible to distinguish the types and the number of sheets of paper in high precision.

Industrial Applicability

As explained above, the paper processing apparatus relating to the present invention is useful for the ATM that handles banknotes as paper.

What is claimed is:

1. A paper processing apparatus comprising:

a conveying unit which conveys sheets of paper after taking them out;

a light irradiating unit which irradiates light onto said sheets of paper that are being conveyed;

a light transmission quantity detecting unit which detects a quantity of light transmitted through said paper;

an external shape judging unit which judges whether an external shape of said paper obtained from the light transmission quantity coincides with a prescribed shape or not;

a correcting unit which corrects the light transmission quantity, when a result of the judgement of the external shape judging unit shows that the external shape of said paper coincides with the prescribed shape and also when the light transmission quantity is lower than a light transmission quantity threshold value that has been set in advance; and a distinguishing unit which distinguishes types of money and a number of sheets of paper, based on a light transmission quantity that has been corrected by the correcting unit.

2. The paper processing apparatus according to claim 1, comprising: a memory unit which stores data of types of money and a total number of sheets of paper held in said apparatus; and a data updating unit which updates the data stored in the memory unit, based on the types of money and the number of sheets of paper distinguished by the distinguishing unit.

3. The paper processing apparatus according to claim 2, comprising: a number-of-sheets-of-paper collating unit which collates the number of sheets of paper taken out by the conveying unit with the number of sheets of paper distinguished by the distinguishing unit, wherein the data updating unit updates the data based on a result of the collation by the number-of-sheets-of-paper collating unit.

* * * * *